US009696675B2

(12) United States Patent
Uchida

(10) Patent No.: US 9,696,675 B2
(45) Date of Patent: Jul. 4, 2017

(54) IMAGE FORMING APPARATUS, IMAGE FORMING SYSTEM, AND IMAGE FORMATION CONTROL METHOD

(71) Applicant: KONICA MINOLTA, INC., Tokyo (JP)

(72) Inventor: Yuji Uchida, Tachikawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/857,139

(22) Filed: Sep. 17, 2015

(65) Prior Publication Data

US 2016/0085195 A1 Mar. 24, 2016

(30) Foreign Application Priority Data

Sep. 18, 2014 (JP) ..... 2014-190215

(51) Int. Cl.
*G03G 15/20* (2006.01)
*G03G 15/00* (2006.01)

(52) U.S. Cl.
CPC ..... *G03G 15/5095* (2013.01); *G03G 15/5062* (2013.01); *G03G 15/556* (2013.01); *G03G 15/6517* (2013.01); *G03G 15/2064* (2013.01); *G03G 15/2078* (2013.01); *G03G 15/5029* (2013.01); *G03G 2215/00738* (2013.01); *G03G 2215/00751* (2013.01)

(58) Field of Classification Search
CPC ..... G03G 15/50
USPC ..... 399/45
See application file for complete search history.

(56) References Cited

U.S. PATENT DOCUMENTS 7,676,177 B2 * 3/2010 Elliot ..... G03G 15/5041 399/160
8,045,871 B2 * 10/2011 Monma ..... G03G 15/0131 399/301
8,867,973 B2 * 10/2014 Masui ..... G03G 15/0189 399/301
2007/0047981 A1 * 3/2007 Ishida ..... G03G 15/0853 399/27

(Continued)

FOREIGN PATENT DOCUMENTS

JP 09-090831 A 4/1997
JP 2006-084796 * 3/2006 ..... G03G 15/00

(Continued)

OTHER PUBLICATIONS

Office Action, JP patent application 2014-190215 with a filing date of Sep. 18, 2014, mailed Oct. 25, 2016, 12 pgs., Japanese Patent Office, Japan.

*Primary Examiner* — Clayton E LaBalle
*Assistant Examiner* — Kevin Butler
(74) *Attorney, Agent, or Firm* — Baker & Hostetler LLP

(57) ABSTRACT

An image forming apparatus or an image forming system, includes a control section to control, at the time of forming an image by using a long sheet with a conveying direction sheet length longer than that of a sheet with a fixed paper size, so as to perform image formation by arranging multiple images on the long sheet, and the control section controls so as to form images repeatedly with a predetermined cycle on the long sheet, detects a margin region being a region where images are not formed on the long sheet, and controls image formation so as to dispose a patch image on the margin region.

27 Claims, 14 Drawing Sheets

(56) References Cited

U.S. PATENT DOCUMENTS

| | | | | |
|---|---|---|---|---|
| 2009/0110420 | A1* | 4/2009 | Sheflin | G03G 15/5041 399/49 |
| 2012/0014703 | A1* | 1/2012 | Karasawa | G03G 15/238 399/49 |
| 2012/0027442 | A1* | 2/2012 | Torimaru | G03G 15/161 399/44 |
| 2014/0125982 | A1* | 5/2014 | Takemura | G03G 15/5062 356/421 |
| 2016/0085195 | A1* | 3/2016 | Uchida | G03G 15/556 399/45 |

FOREIGN PATENT DOCUMENTS

| | | | | |
|---|---|---|---|---|
| JP | 2006-084796 | A | 3/2006 | |
| JP | 2010-091806 | A | 4/2010 | |
| JP | 2011-285311 | * | 12/2011 | B41J 2/01 |
| JP | 2012-194267 | A | 11/2012 | |
| JP | 2013-132847 | A | 7/2013 | |

* cited by examiner

IMAGE FORMING APPARATUS, IMAGE FORMING SYSTEM, AND IMAGE FORMATION CONTROL METHOD

The present application claims the priority under the Paris Convention based on Japanese Patent Application No. 2014-190215 filed on Sep. 18, 2014, in accordance with the provisions in Article 119 in the United States Patent Law.

BACKGROUND OF THE INVENTION

Field of the Invention

The present invention relates to an image forming apparatus, an image forming system, and an image formation control method, and, in particular, relates to a technique to execute control efficiently in the case of forming images repeatedly on a long sheet such as a rolled sheet.

Description of Related Art

In image forming apparatuses, generally, images are formed on a sheet called a cut sheet which is cut in a predetermined fixed sheet size, such as a letter size. On the other hand, in image forming apparatuses, images can be also formed on a long sheet called a rolled sheet. Such a long sheet has a length of about several hundred meters or several kilometers, and, in many cases, the long sheet is used for a purpose of printing a label repeatedly.

In image forming apparatuses of a electrophotographying system, processing (image stabilization processing) for stabilizing image density is generally performed periodically.

For example, in an image forming apparatus which uses sheets of a fixed paper size, a patch image with a prescribed density (optical density) is drawn on a transfer member, such as an intermediate transfer belt with a timing within an interval between a sheet and a sheet. Then, the density of this patch image is read by a density sensor, and an image forming section executes correction based on the density so as to enable image formation with stable density.

Further, in such an image forming apparatus of an electrophotographying system, when toner to be used for image formation becomes old, there is a control technique to form a toner consumption patch image so as to discard the old toner positively. In this case, the discarding of the old toner enables stable image formation.

However, in the case of image formation by using a long sheet, there is no space between sheets and there exists a sheet always in an image forming apparatus. Accordingly, if a patch image is drawn, the patch image is made to be transferred at some position on a sheet. Therefore, in order to execute image stabilization processing, it is necessary to secure a region on a sheet where a patch image is drawn.

However, in image formation by using a long sheet, in many cases, a gap in a sub scanning direction (sheet conveying direction) between an image and another image is about 1 mm. Accordingly, it is difficult to secure a region where a patch image is drawn.

Then, in order to draw a patch image, a technique to stop image output in the sub scanning direction for a predetermined period may be considered. However, in this case, a cycle from an image to a next image is made to change.

Therefore, a post processing apparatus connected to a back stage of an image forming apparatus is required to perform control in consideration of a patch image cycle, which results in that the control required for the post processing apparatus becomes complicate. In this case, with a sudden control change of the post processing apparatus, there is a possibility that the quality of an output matter may deteriorate. Further, there is also a problem that waste sheets may increase correspondingly to the stop of image formation.

With regard to control in image forming apparatuses which use a long sheet or a continuous sheet, various kinds of proposals have been made by Japanese Unexamined Patent Publication Nos. 2013-132847 (Document 1) and 2006-84796 (Document 2).

SUMMARY OF THE INVENTION

In the above Document 1, at the time of performing printing for a continuous sheet on which a pattern or a mark is printed beforehand, the sheet is scanned, and then, a patch image is printed on a margin region on the sheet. In this case, control is performed for a sheet on which a pattern or a mark has been already printed, and the sheet is made to be scanned. Accordingly, such control cannot be applied for a purpose for density control or forming a patch image to consume toner.

In the above Document 2, a patch image is added on an edge portion of a sheet and read by a sensor, and an image is applied with correction. Further, in the case where a value read by the sensor exceeds a threshold, an image interval is made wider, and a patch image is added at a central portion of a sheet.

In this case, in order to add a patch image at a central portion of a sheet, it is necessary to change a cycle of image formation. As a result, in the case where a post processing apparatus is connected, the post processing apparatus is required to perform interlocking control, which makes control troublesome.

An object of the present invention is to provide an image forming apparatus, an image forming system, and an image formation control method each of which can form a patch image without changing a cycle of images in the case of forming images on a long sheet.

That is, in order to solve the above-mentioned problems, an image forming apparatus, an image forming system, and an image formation control method to each of which one aspect of the present invention is reflected are constituted as follows.

(1) An image forming apparatus or an image forming system, includes a control section which controls, in the case of forming an image by using a long sheet with a sheet length in a conveying direction longer than that of a sheet length with a fixed paper size, so as to perform image formation by arranging multiple images on the long sheet; wherein the control section controls so as to form images repeatedly with a predetermined cycle on the long sheet, detects a margin region being a region where images are not formed on the long sheet, and controls image formation so as to dispose a patch image on the margin region.

(2) In the above (1), in the case where a direction to convey the long sheet during image formation is made to a sub scanning direction and a direction orthogonal to the sub scanning direction on the long sheet is made to a main scanning direction, the control section detects the margin region in the main scanning direction and controls image formation so as to dispose the patch image on the margin region.

(3) In the above (2), in the case where image formation is performed by making toner adhere to the long sheet, and in the case of detecting multiple margin regions in the main scanning direction, the control section controls image formation so as to dispose a toner consumption patch image to consume toner on at least two or more margin regions among the multiple margin regions.

(4) In the above (2) or (3), in the case where image formation is performed by making multiple different color toners adhere to the long sheet, the control section controls image formation so as to dispose preferentially a toner consumption patch image of a color toner consumed little as compared with other color toners.

(5) In any of the above (1) to (4), in the case where a direction to convey the long sheet during image formation is made to a sub scanning direction and a direction orthogonal to the sub scanning direction on the long sheet is made to a main scanning direction, a sensor to detect a density of an image is disposed at a predetermined position in the main scanning direction, and the control section detects a margin region in the main scanning direction and controls image formation so as to dispose a density adjustment patch image on the margin region at a position which coincides with the position of the sensor in the main scanning direction.

(6) In any of the above (1) to (5), the control section adjusts arrangement in the main scanning direction in the case of forming images on the long sheet, produces a margin region at a position which coincides with the position of the sensor in the main scanning direction, and controls image formation so as to dispose a density adjustment patch image on the produced margin region.

(7) In the above (6), when the control section adjusts the arrangement in the main scanning direction in the case of forming images on the long sheet and produces the margin region at the position which coincides with the position of the sensor in the main scanning direction, the control section executes the adjustment of the arrangement by any one of replacement of the order of the images in the main scanning direction, shift of the images in the main scanning direction, and replacement of the order of the images in the main scanning direction and shift of the images in the main scanning direction.

(8) In any one of the above (1) to (7), in the case where a direction to convey the long sheet during image formation is made to a sub scanning direction and a direction orthogonal to the sub scanning direction on the long sheet is made to a main scanning direction, a sensor to detect a density of an image is disposed at a predetermined position in the main scanning direction; and in the case where a margin region is detected in the main scanning direction and the detected margin region does not exist at a position which coincides with the position of the sensor in the main scanning direction, or in the case where, even though a margin region is detected in the main scanning direction and the arrangement of images is adjusted, a margin region cannot be produced at a position which coincides with the position of the sensor in the main scanning direction, the control section sets the predetermined cycle to repeat image formation to be longer than the case of forming only images, whereby the control section produces a margin region in the sub scanning direction within the predetermined cycle, and controls image formation so as to dispose a density adjustment patch image at a position which locates in the produced margin region and coincides with the position of the sensor in the main scanning direction.

(9) In any one of the above (1) to (7), in the case where a direction to convey the long sheet during image formation is made to a sub scanning direction and a direction orthogonal to the sub scanning direction on the long sheet is made to a main scanning direction, a sensor to detect a density of an image is disposed at a predetermined position in the main scanning direction; and in the case where a margin region is detected in the main scanning direction and the detected margin region does not exist at a position which coincides with the position of the sensor in the main scanning direction, or in the case where, even though a margin region is detected in the main scanning direction and the arrangement of images is adjusted, a margin region cannot be produced at a position which coincides with the position of the sensor in the main scanning direction, the control section controls image formation in any one cycle among the predetermined cycles so as to dispose a density adjustment patch image on at least a position which coincides with the position of the sensor in the main scanning direction without disposing images for image formation.

(10) In any one of the above (1) to (9), in the case where a direction to convey the long sheet during image formation is made to a sub scanning direction and a direction orthogonal to the sub scanning direction on the long sheet is made to a main scanning direction, a sensor to detect a density of an image is disposed at a predetermined position in the main scanning direction, and the control section detects the margin region in the main scanning direction, controls image formation so as to dispose a density adjustment patch image on the margin region at a position which coincides with the position of the sensor in the main scanning direction, and controls image formation so as to dispose a toner consumption patch image to consume toner on the margin region other than the position where the density adjustment patch image is formed.

(11) In any one of the above (5) to (10), in the case where the control section detects the margin region in the main scanning direction and controls image formation so as to dispose a density adjustment patch image on the margin region at a position which coincides with the position of the sensor in the main scanning direction, the control section controls so as to maintain the arrangement in a predetermined state from start to end of a job as a unit of a series of image formation.

(12) In any one of the above (1) to (11), in the case where first information regarding the color or density of an image in a figure region and second information regarding attribute showing whether an image is a figure region or a background region are exist, the control section detects the margin region with reference to the second information.

(13) In any one of the above (1) to (11), in the case where coordinate information regarding arrangement of images exists, the control section detects the margin region with reference to the coordinate information.

(14) An image forming system, includes a sheet feeding apparatus which feeds a long sheet with a conveying direction sheet length longer than that of a sheet length with a fixed paper size, and the image forming apparatus described in any one of the above (1) to (13) which forms images on the long sheet fed from the sheet feeding apparatus.

(15) An image forming system, includes a sheet feeding apparatus which feeds a long sheet with a sheet length longer in a conveying direction than that of a sheet with a fixed paper size, an image forming apparatus which forms images on the long sheet fed from the sheet feeding apparatus, and a control apparatus which controls image formation so as to arrange multiple images on the long sheet, wherein the control apparatus controls so as to form images repeatedly with a predetermined cycle on the long sheet, detects a margin region being a region where images are not formed on the long sheet, and controls image formation so as to dispose a patch image on the margin region.

DETAILED DESCRIPTION OF THE PREFERRED EMBODIMENT

Hereinafter, with reference to drawings, description will be given in detail to an embodiment to form a patch image without changing a cycle of images at the time of performing image formation repeatedly with a predetermined cycle to a long sheet in an image forming apparatus, an image forming system, and an image formation control method.

Constitution of an Image Forming System

Figure 1:
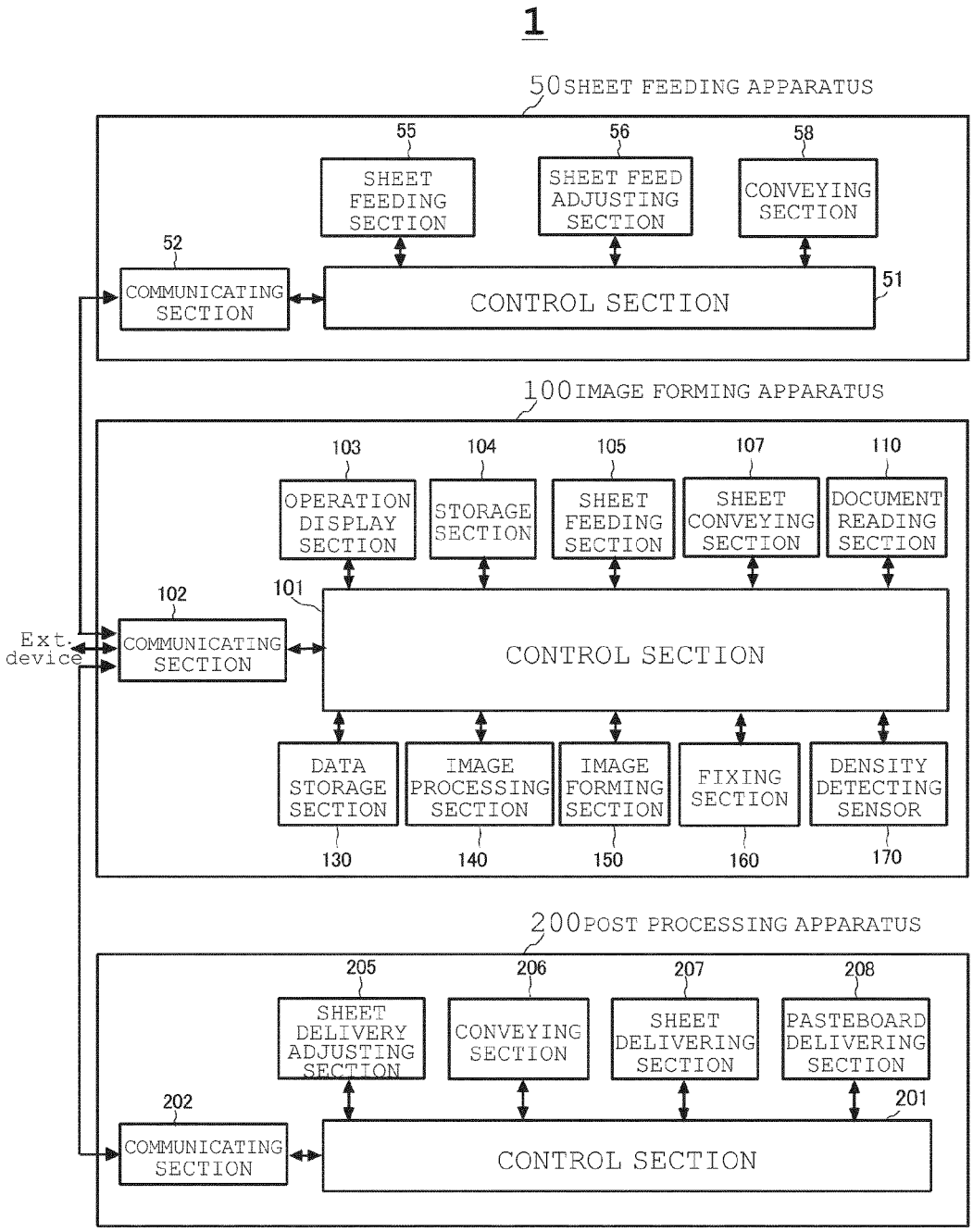
FIG. 1 is a constitution drawing showing a constitution of an image forming system of an embodiment of the present invention.
Figure 2:
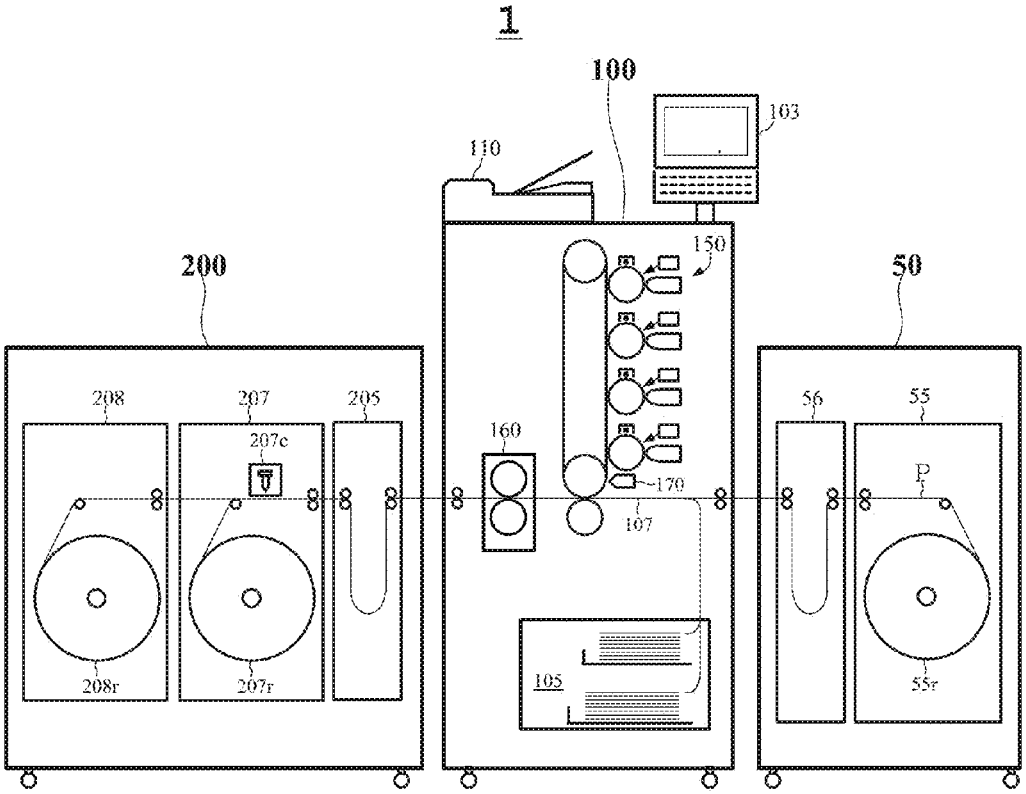
FIG. 2 is a constitution drawing showing a constitution of an image forming system of an embodiment of the present invention.

Herein, based on FIG. 1 and FIG. 2, description is given in detail to a constitution example of an image forming system 1 in which a sheet feeding apparatus 50, an image forming apparatus 100, and a post processing apparatus 200 are connected.

In this embodiment, the sheet feeding apparatus 50, the image forming apparatus 100, and the post processing apparatus 200 are connected so as to make it possible to form images by using a long sheet with a conveying direction sheet length (a sheet length in a conveying direction) longer than that of a sheet length with a fixed paper size. The sheet with a fixed paper size is a sheet with a standardized size and one of sheets such as a letter size sheet.

The sheet feeding apparatus 50 is constituted so as to include a control section 51, a communicating section 52, a sheet feeding section 55, a sheet feed adjusting section 56, and a conveying section 58. The above sections are configured to operate in the following ways. The control section 51 controls each section in the sheet feeding apparatus 50. The communicating section 52 communicates with other connected apparatuses such as the image forming apparatus 100. The sheet feeding section 55 feeds a long sheet from a sheet roll to the image forming apparatus 100. The sheet feed adjusting section 56 absorbs fluctuation in a conveying speed while adjusting a degree of tension in a sheet fed from the sheet feeding section 55. The conveying section 58 conveys a sheet in the sheet feeding apparatus 50.

The image forming apparatus 100 is constituted so as to include a control section 101, a communicating section 102, an operation display section 103, a storage section 104, a sheet feeding section 105, a sheet conveying section 107, a document reading section 110, a data storage section 130, an image processing section 140, an image forming section 150, a fixing section 160, and a density detecting sensor 170. The above sections are configured to operate in the following ways. The control section 101 controls each section in the image forming apparatus 100. The communicating section 102 communicates with other connected apparatuses (such as an external device, the sheet feeding apparatus 50, and a post processing apparatus 200). The operation display section 103 receives an operation input by a user and displays the state of the image forming apparatus 100. The storage section 104 stores various kinds of setting. The sheet feeding section 105 can feed sheets accommodated in a sheet feed tray. The sheet conveying section 107 conveys sheets in the apparatus. The document reading section 110 reads an image on a document with an image sensor and produces document image data. The data storage section 130 stores image data and various kinds of data at the time of image formation. The image processing section 140 executes various kinds of image processing required for image formation. The image forming section 150 forms an image on a sheet based on an image formation command and image data. The fixing section 160 stabilizes a toner image formed on the sheet by heat and a pressure. The density detecting sensor 170 detects the density (optical density) of a patch image.

The image forming apparatus 100 can perform image formation for a long sheet. However, the image forming apparatus 100 may perform image formation for a sheet with a fixed sheet size.

The control section 101 is provided with a control function to control to form images repeatedly with a predetermined cycle on a long sheet as mentioned later, and, in addition, to control to detect a margin region being a region where images are not formed on a long sheet and to perform image formation so as to arrange patch images on the margin region.

The post processing apparatus 200 is constituted so as to include a control section 201, a communicating section 202, a sheet delivery adjusting section 205, a conveying section 206, a sheet delivering section 207, and a pasteboard delivering section 208. The above sections are configured to operate in the following ways. The control section 201 controls each section in the post processing apparatus 200. The communicating section 202 communicates with other connected apparatuses such as the image forming apparatus 100. The sheet delivery adjusting section 205 absorbs fluctuation in a conveying speed while adjusting a degree of tension in a sheet delivered from the image forming apparatus 100. The conveying section 206 conveys a sheet in the post processing apparatus 200. The sheet delivering section 207 delivers a sheet as a sheet roll while winding up a long sheet from the image forming apparatus 100. The pasteboard delivering section 208 delivers a sheet as a sheet roll while winding up a pasteboard of a long sheet from the image forming apparatus 100. The sheet delivering section 207 may include a cutting part 207*c* to cut out label portions of a long sheet as required.

In FIG. 2, a case where an unfixed type long sheet is handled by the sheet feeding apparatus 50, the image forming apparatus 100, and the post processing apparatus 20 is shown as a specific example. Herein, a long sheet means a sheet with a sheet length in a conveying direction longer than that of a sheet length with a fixed sheet size.

Further, in FIG. 2, the image forming section 150 is configured to perform image formation with multiple different colors. However, the image forming section 150 should not be limited to this mode, and the image forming section 150 may be configured to perform image formation with monochrome color.

various kinds of constitutions may be considered for sheet feeding, image formation, and sheet delivering, and FIG. 2 shows merely one example of them. Accordingly, the present invention should not be limited to this embodiment.

Whole Operation in an Image Forming Apparatus and an Image Forming System

Figure 3:
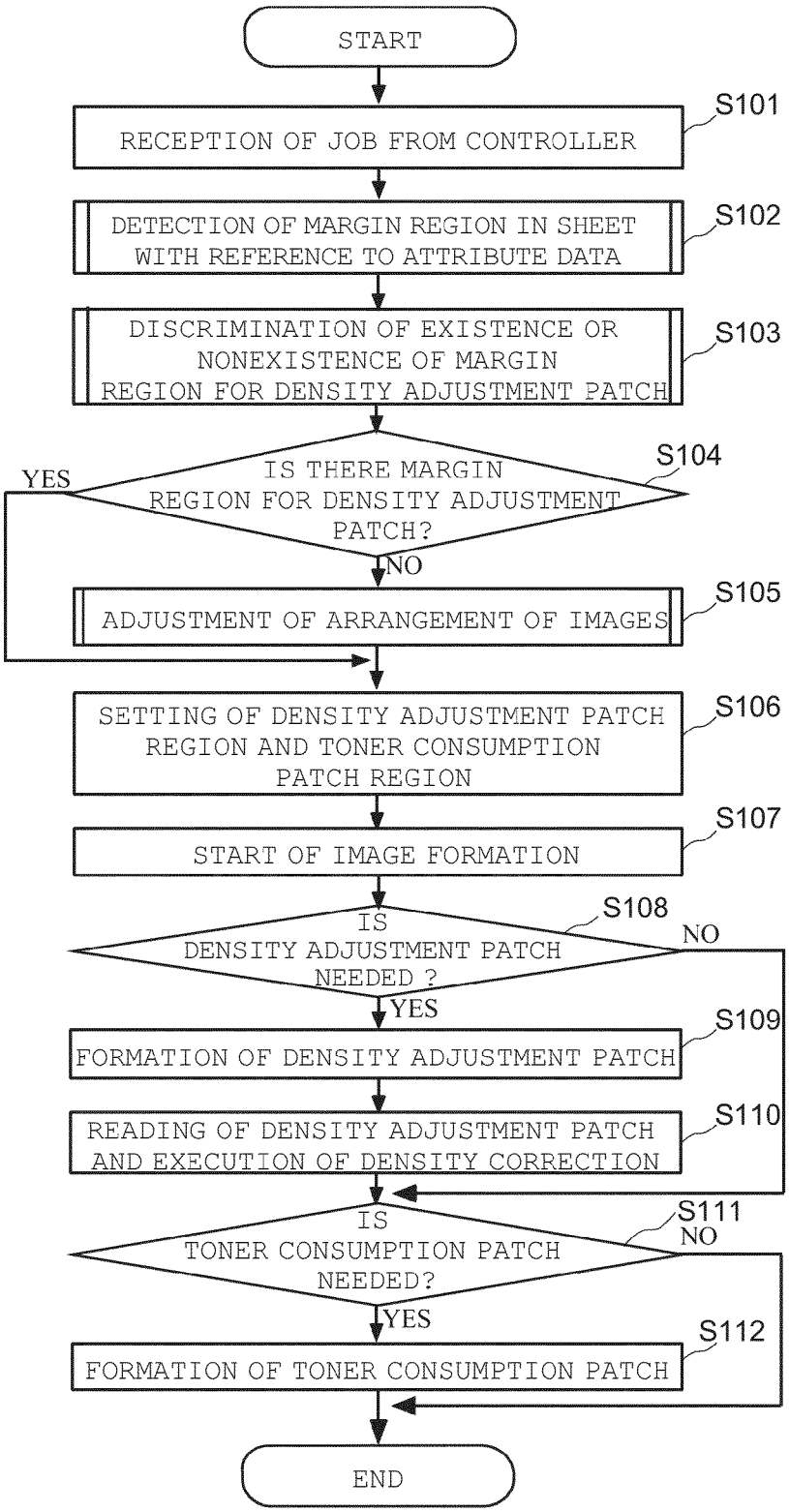
FIG. 3 is a flow chart showing operation of a sheet feeding apparatus of an embodiment of the present invention.

The image forming apparatus 100 receives a job from external devices, such as a controller (Step S101 in FIG. 3).

Herein, the job received by the image forming apparatus 100 includes image data which show the contents of images and job ticket data which show to execute what kind of image formation and post processing with what kind of cycle by repeating what number of times.

Further, the image data include color data as first information regarding the colors or optical density of images formed in a figure region and attribute data as second information showing whether images are formed in a figure region or a background region.

In the case of color image formation, color data corresponds in amount to four color components of YMCK. Therefore, image data are constituted by five components composed of the color data corresponding to four color components and attribute data. Further, in monochrome image formation, color data correspond in amount to one color component. Therefore, image data are constituted by two components composed of the color data corresponding to one color component and attribute data.

Figure 4:
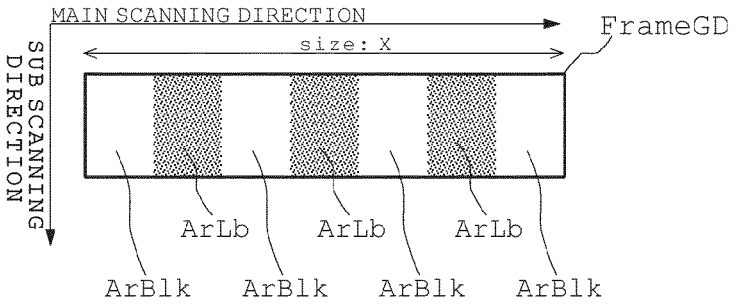
FIG. 4 is an explanatory drawing showing a state of images of an embodiment of the present invention.

Here, FIG. 4 shows an example of image data. In an image data frame FrameGD, a label region ArLb where a label is formed by image formation and a margin region ArBlk where a label is not formed by image formation are arranged alternately in the main scanning direction. It is assumed that the main scanning direction size X of the image data frame FrameGD coincides with the main scanning direction size of a long sheet.

Figure 5:
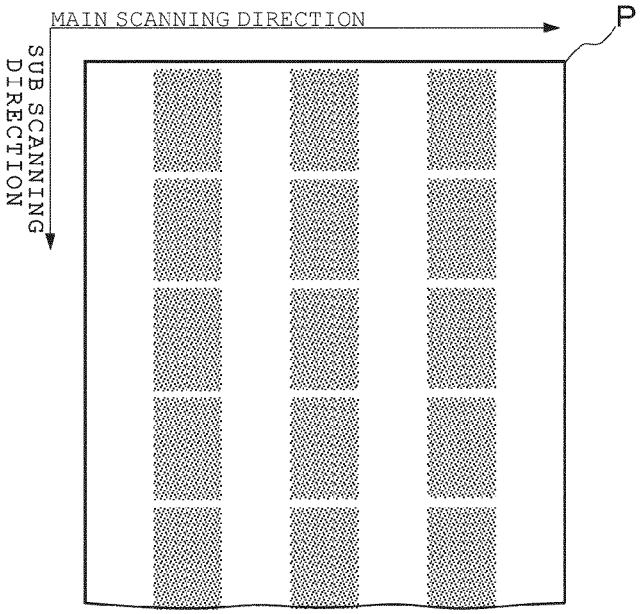
FIG. 5 is an explanatory drawing showing a state of images of an embodiment of the present invention.

FIG. 5 schematically shows a state that image formation is performed repeatedly with a predetermined cycle in a sub scanning direction on a long sheet P by using the image data shown in FIG. 4.

Figure 6:
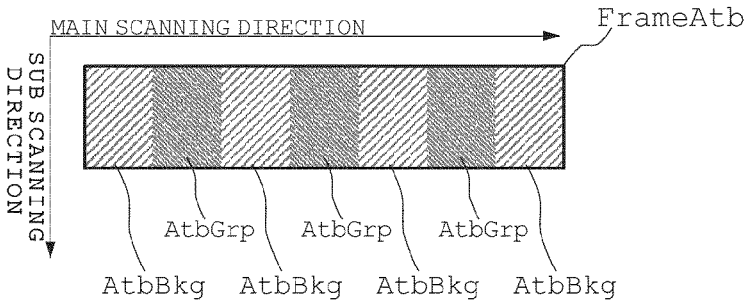
FIG. 6 is an explanatory drawing showing a state of images of an embodiment of the present invention.

FIG. 6 shows an example of attribute data. In an attribute data frame FrameAtb, a figure attribute AtbGrp of a label region ArLb (FIG. 4) where a label is formed by image formation and a background attribute AtbBkg of a margin region ArBlk (FIG. 4) where a label is not formed by image formation are arranged alternately in the main scanning direction correspondingly to the image data shown in FIG. 4.

The figure attribute AtbGrp may include a character attribute. Namely, in this embodiment, it may be permissible to discriminate between a background attribute showing a margin region and a figure attribute as a label region where certain image formation such as a character and a figure is performed. Therefore, in this embodiment, in the case of calling a figure attribute, attributes such as characters other than a margin attribute may be included.

The control section 101 makes the data storage section 130 store the image data and attribute data of the received job, and detects a margin region with reference to the attribute data (Step S102 in FIG. 3). Further, the control section 101 detects the margin region ArBlk (FIG. 4) by paying attention to the background attribute AtbBkg (refer to FIG. 6) included in the attribute data.

In this embodiment, since a margin region is detected with reference to the attribute data, it is not likely to judge erroneously a portion in which characters or images do not exist in a label region, as a margin.

Further, in the case of forming a toner consumption patch image for toner consumption, this margin region may exist at any position in the main scanning direction. On the other hand, in the case of forming a density adjustment patch image for density adjustment, this margin region is required to coincide with a position of the density detecting sensor 170.

Hereinafter, description is given to a margin region detection (Step S102 in FIG. 3) with reference to a flow chart of a subroutine shown in FIG. 7.

Figure 7:
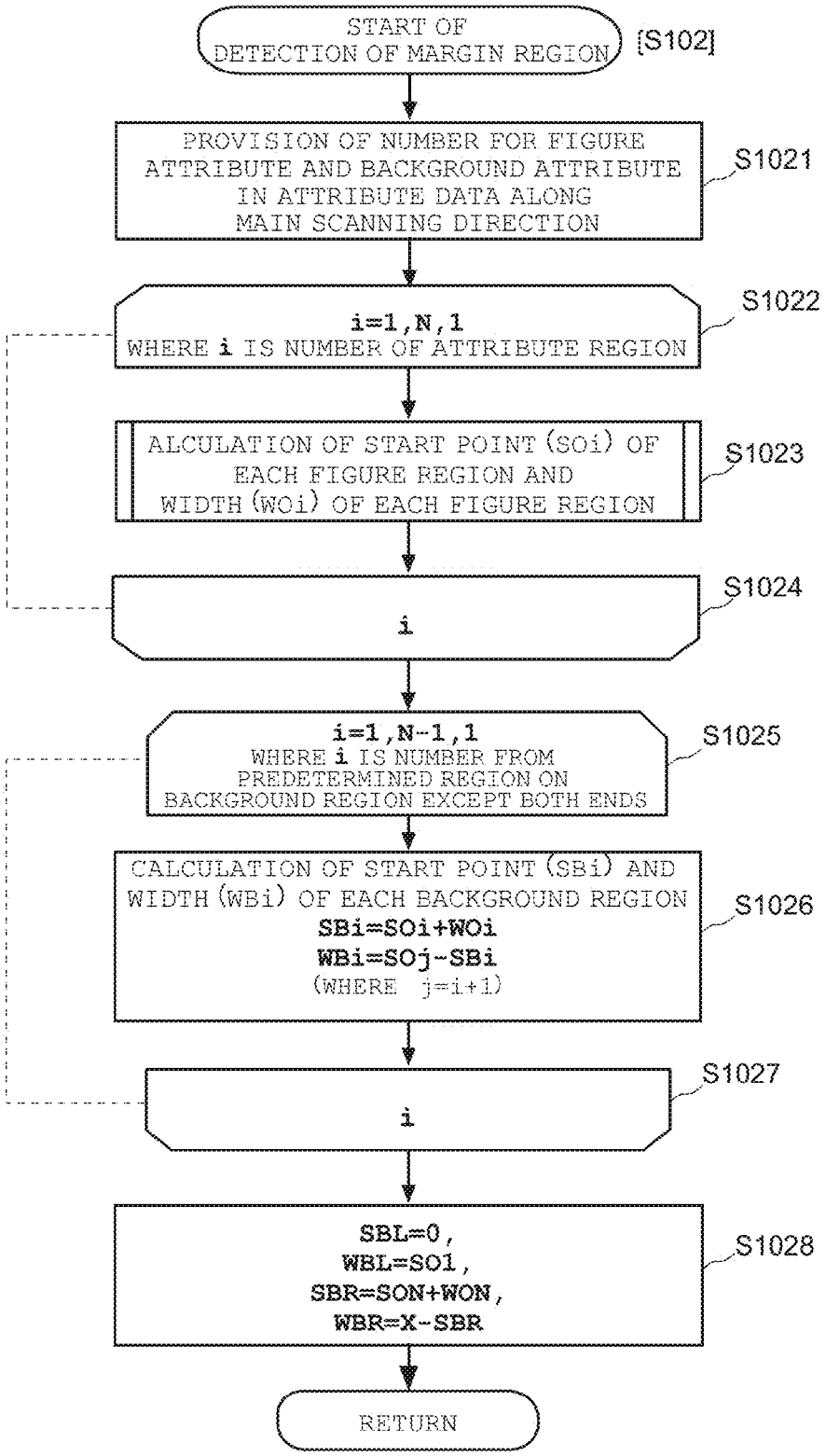
FIG. 7 is a flow chart showing operation of a sheet feeding apparatus of an embodiment of the present invention.
Figure 8:
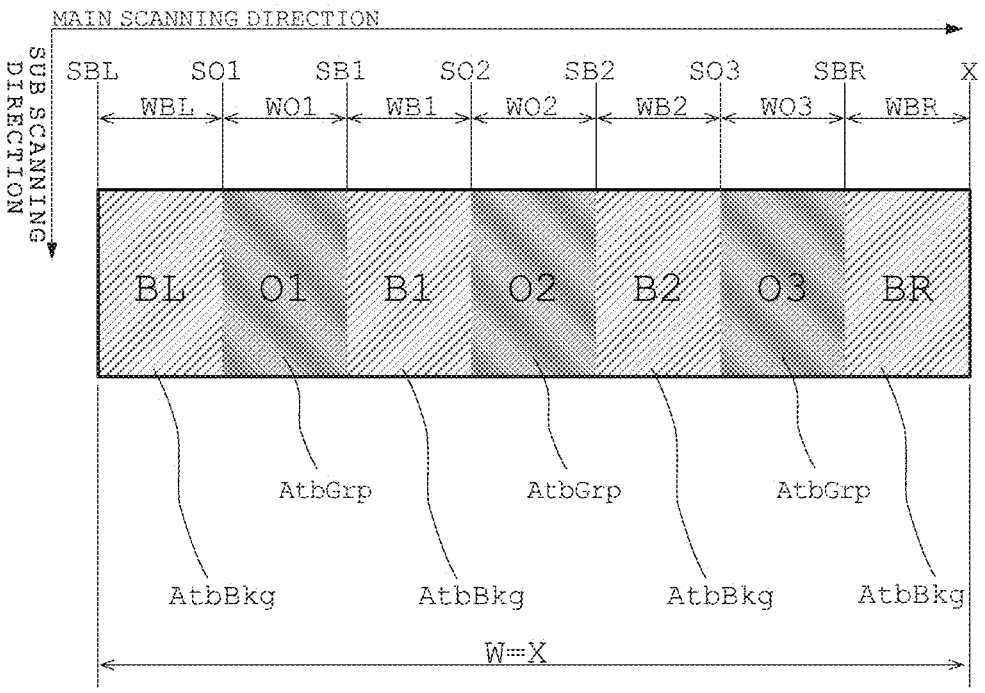
FIG. 8 is an explanatory drawing showing a state of images of an embodiment of the present invention.

First, the control section 101 provides each of a background attribute region and a figure attribute region in the attribute data with a number along the main scanning direction as shown in FIG. 8 (Step S1021 in FIG. 7). In this case, a smaller number is provided from the start side in the main scanning direction.

Herein, a background attribute region (BL and BR in FIG. 8) of each of both ends is not made as a target to be provided with a number, because such a background attribute region exists at a sheet end portion in the main scanning direction and cannot be moved.

Namely, in FIG. 8, viewing from the left end being the start side in the main scanning direction, a number is provided to a background attribute region BL on the left end portion, a figure attribute region O1 neighboring on the right side of the background attribute region BL, a background attribute region B1 neighboring on the right side of the figure attribute region O1, a figure attribute region O2 neighboring on the right side of the background attribute region B1, a background attribute region B2 neighboring on the right side of the figure attribute region O2, a figure attribute region O3 neighboring on the right side of the background attribute region B2, and a background attribute region BR neighboring on the right side of the figure attribute region O3.

After providing the number i to each of the attribute regions, the control section 101 calculates a start point coordinate SOi of each figure attribute region and a width WOi of each figure attribute region sequentially, (Step S1022 to S1024 in FIG. 7).

Figure 9:
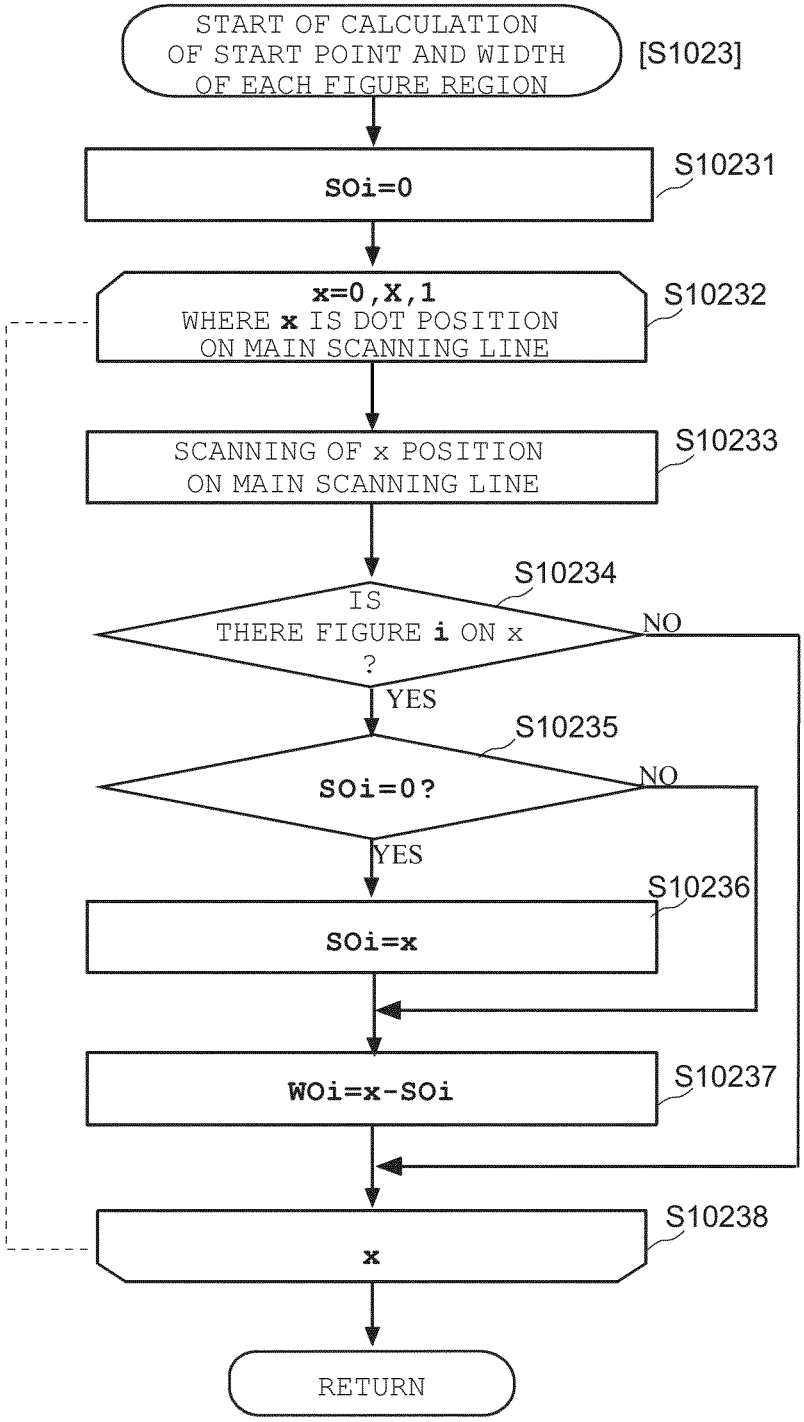
FIG. 9 is a flow chart showing operation of a sheet feeding apparatus of an embodiment of the present invention.

Herein, with reference to a flow chart shown in FIG. 9, description is given to calculation (Step S1023 in FIG. 7) of a start point coordinate SOi of each figure attribute region and a width WOi of each figure attribute region.

First, a start point coordinate SOi of an i-th figure attribute region is made to 0 (SOi=0) (Step S10231 in FIG. 9). Here, the reason why the start point coordinate SOi is made to 0 (SOi=0) is that it is a temporary value for calculation.

Successively, scanning is performed along a line in the main scanning direction for the inside of each of the background attribute regions and the figure attribute regions shown in FIG. 8. At this time, with regard to a target dot position x, judgement (Steps S10233 and S10234 in FIG. 9) is made for whether a figure attribute region i (i-th figure attribute region Oi) exists on the target dot position x, from a start point 0 to an end point X (the maximum value in the main scanning direction) by a one dot step in the main scanning direction. Herein, the sign i in this flow chart shown in FIG. 9 is the sign i set in the flow chart shown in FIG. 7. For this reason, the existence of figure attribute regions other than i is disregarded in processing in the flow chart shown in FIG. 9.

If the figure attribute region i does not exist on the target dot position x by the scanning (NO at Step S10234 in FIG. 9), x is incremented one by one (Step S10238 to S10232 in FIG. 9).

If the existence of the figure attribute region i is detected at the first time on the target dot position x by scanning (YES at Step S10234 and YES at Step S10235 in FIG. 9), the start point coordinate SOi of the figure attribute region i is set to (SOi=x) (Step S10236 in FIG. 9).

Then, the width WOi with regard to the figure attribute region i is calculated by (WOi=x−SOi). At a time point when the start point coordinate SOi is detected, since x and SOi are equal to each other, calculation is started as (WOi=0).

Then, if the existence of the figure attribute region i is successively detected on the incremented target dot position x (YES at Step S10234 and NO at Step S10235 in FIG. 9), the detection result of the width WOi of the figure attribute region i increases as (WOi=x−Soi) in accordance with the increment of x (Step S10237 in FIG. 9). If the existence of the figure attribute region i is not detected on the target dot position x (NO at Step S10234 in FIG. 9), the detection result of the width WOi of the figure attribute region i is determined.

With the processing as mentioned above, the start point coordinate SOi of the figure attribute region i and the width WOi of the figure attribute region i are calculated from (i=1) to the maximum value N. In the example shown in FIG. 8, the maximum value N is 3.

Here, processing is returned to the flow chart shown in FIG. 7, and the control section 101 calculates the start point coordinate SBi of each background attribute region and the width WBi of each background attribute region sequentially (Step S1025 to S1027 in FIG. 7).

The start point coordinate SBi of each background attribute region can be calculated by (SBi=SOi+WOi) by using the start point coordinate SOi and the width WOi of each figure attribute region i.

Further, the width WBi of each background attribute region is calculated by (WBi=SOj−Sbi) by using the start point coordinate SBi of each background attribute region i and the start point coordinate SOj of the next figure attribute region j. Here, j=i+1.

Further, processing is made so as to calculate a start point coordinate SBL (=0) of the left end background region, a width WBL (=SO1) of the left end background region, a start point coordinate SBR (=SON+WON) of the right end background region, and a width WBR (=X−SBR) of the right end background region (Step S1028 in FIG. 7).

With the processing as mentioned above, the processing of the subroutine shown in FIG. 7 with regard to the margin region detection (Step S102 in FIG. 3) is ended.

Herein, the processing is returned to the main flow chart shown in FIG. 3, and the control section 101 discriminates whether a margin region for a density adjustment patch image exists or not in the detected margin regions (Step S103 in FIG. 3). Herein, a margin region for a density adjustment patch image means a margin region corresponding to a position in the main scanning direction where a density detecting sensor 170 is disposed.

Hereinafter, with reference to a flow chart of a subroutine shown in FIG. 10, description is given to the discrimination as to whether a margin region for a density adjustment patch image exists or not (Step S103 in FIG. 3).

Figure 10:
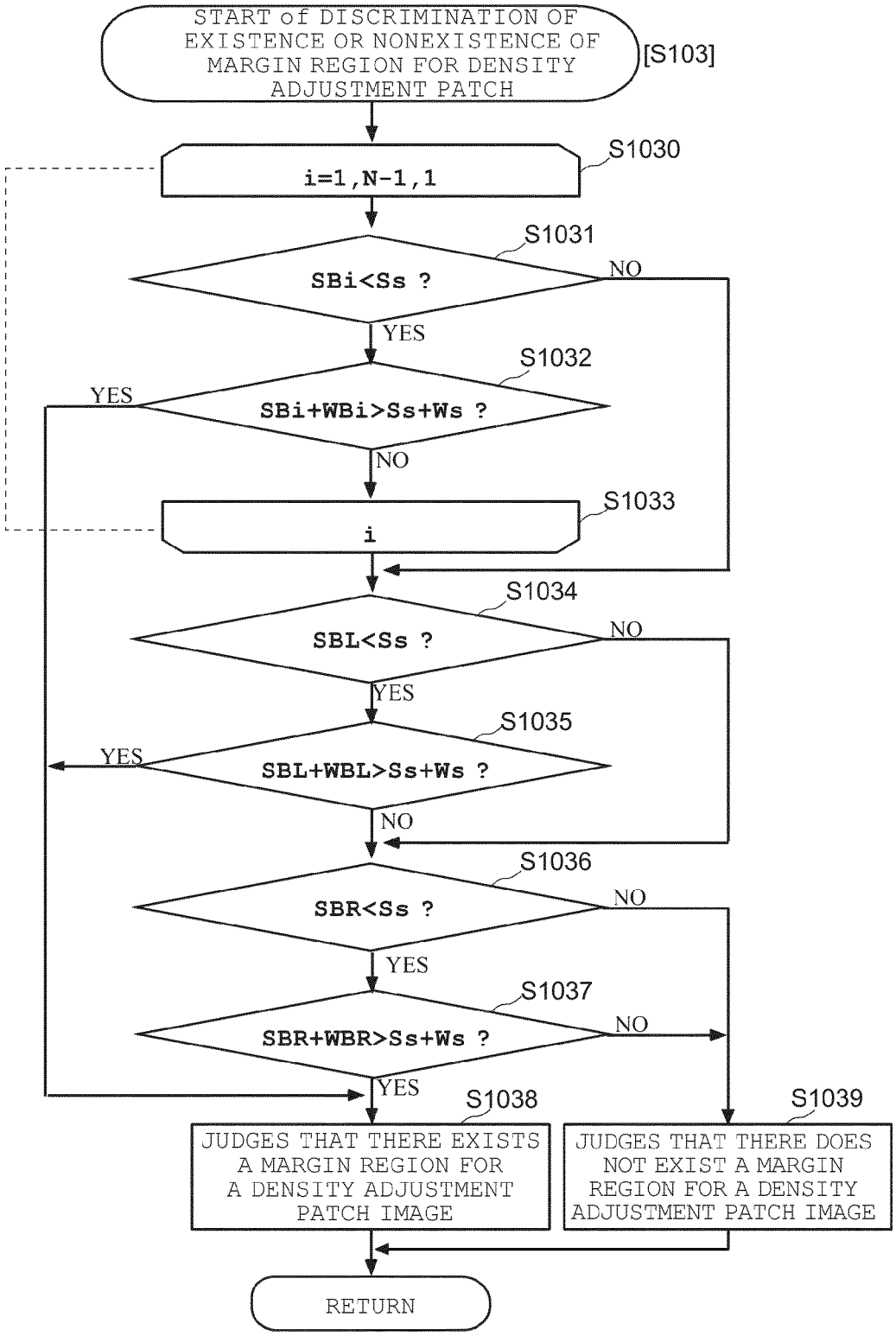
FIG. 10 is a flow chart showing operation of a sheet feeding apparatus of an embodiment of the present invention.

First, at one step of making i from 1 to N−1 (Step S1030 in FIG. 10), the control section 101 judges whether the start point coordinate SBi of the i-th background attribute region in the attribute data is smaller than the start point coordinate Ss of the density detecting sensor 170 (Step S1031 in FIG. 10).

In this case, a matter that the start point coordinate SBi of the i-th background attribute region is smaller than the start point coordinate Ss of the density detecting sensor 170, means that SBi is located on the start end side (in FIG. 8, the left side) rather than Ss.

Successively, the control section 101 judges whether (the start point coordinate SBi of the i-th background attribute region in the attribute data+the width WBi of the background attribute region) is larger than (the start point coordinate Ss of the density detecting sensor 170+the width Ws of the density detecting sensor 170) (Step S1032 in FIG. 10). In this case, a matter that ((SBi+WBi)>(Ss+Ws)) means that the end point of the i-th background attribute region is located on the terminal end side (in FIG. 8, the right side) rather than the terminal end of the density detecting sensor 170.

Namely, in the case where (SBi<Ss) and ((SBi+WBi)>(Ss+Ws)) (YES at S1031 and YES in Step S1032 in FIG. 10), it means that there exists the i-th background attribute region which covers the density detecting sensor 170. Accordingly, the control section 101 judges that there exists a margin region for a density adjustment patch image (Step S1038 in FIG. 10).

On the other hand, in the case where (SBi<Ss) is satisfied, but ((SBi+WBi)>(Ss+Ws)) is not satisfied (YES at S1031 and NO in Step S1032 in FIG. 10), there is a possibility that the i-th background attribute region itself is located on the left side rather than the density detecting sensor 170, i is incremented and the judgment is continued (NO Step S1032 and S10133, S1030 to in FIG. 10).

Further, in the case where (SBi<Ss) is not satisfied (NO at Step S1031 in FIG. 10), since the i-th background attribute region itself is located on the right side rather than the density detecting sensor 170, the processing proceeds to the next processing (NO at Step S1031, and S1034 to in FIG. 10).

Herein, the control section 101 judges whether the start point coordinate SBL of the background attribute region on the start end side (the left end side) in the attribute data is smaller than the start point coordinate Ss of the density detecting sensor 170 (Step S1034 in FIG. 10). In this case, a matter that the start point coordinate SBL of the background attribute region on the left end is smaller than the start point coordinate Ss of the density detecting sensor 170, means that SBL is located on the start end side (in FIG. 8, the left side) rather than Ss.

Successively, the control section 101 judges whether (the start point coordinate SBL of the background attribute region on the start end side in the attribute data+the width WBL of the background attribute region) is larger than (the start point coordinate Ss of the density detecting sensor 170+the width Ws of the density detecting sensor 170) (Step S1035 in FIG. 10).

In this case, a matter that ((SBL+WBL)>(Ss+Ws)) means that the terminal end of the background attribute region on the left end is located on the terminal end side (in FIG. 8, the right side) rather than the terminal end of the density detecting sensor 170.

Namely, in the case where (SBL<Ss) and ((SBL+WBL)>(Ss+Ws)) (YES at S1034 and YES at Step S1035 in FIG. 10), it means that the background attribute region on the left end side covers the density detecting sensor 170. Accordingly, the control section 101 judges that there exists a margin region for a density adjustment patch image (Step S1038 in FIG. 10).

On the other hand, in the case where (SBL<Ss) is satisfied, but (SBL+WBL>Ss+Ws) is not satisfied (YES at S1034 and NO at Step S1035 in FIG. 10), or (SBL<Ss) is not satisfied (NO at Step S1034 in FIG. 10), since the background attribute region on the left end does not correspond to a margin region for a density adjustment patch image, the processing proceeds to the next processing (Step S1036 to in FIG. 10).

Herein, the control section 101 judges whether the start point coordinate SBR of the background attribute region on the terminal end side (the right end side) in the attribute data is smaller than the start point coordinate Ss of the density detecting sensor 170 (Step S1036 in FIG. 10). In this case, a matter that the start point coordinate SBR of the background attribute region on the right end is smaller than the start point coordinate Ss of the density detecting sensor 170, means that SBR is located on the start end side (in FIG. 8, the left side) rather than Ss.

Successively, the control section 101 judges whether (the start point coordinate SBR of the background attribute region on the terminal end side in the attribute data+the width WBR of the background attribute region) is larger than (the start point coordinate Ss of the density detecting sensor 170+the width Ws of the density detecting sensor 170) (Step S1037 in FIG. 10).

In this case, a matter that ((SBR+WBR)>(Ss+Ws)) means that the terminal end of the background attribute region on the right end is located on the terminal end side (in FIG. 8, the right side) rather than the terminal end of the density detecting sensor 170.

Namely, in the case where (SBR<Ss) and ((SBR+WBR)>(Ss+Ws)) (YES at S1036 and YES in Step S1037 in FIG. 10), it means that the background attribute region on the right end side covers the density detecting sensor 170. Accordingly, the control section 101 judges that there exists a margin region for a density adjustment patch image (Step S1038 in FIG. 10).

On the other hand, in the case where (SBR<Ss) is satisfied, but ((SBR+WBR)>(Ss+Ws)) is not satisfied (YES at S1036 and NO at Step S1037 in FIG. 10), or (SBR<Ss) is not satisfied (NO at Step S1036 in FIG. 10), since the background attribute region on the right end does not correspond to a margin region for a density adjustment patch image, the control section 101 judges that there does not exist a margin region for a density adjustment patch image (Step S1039 in FIG. 10).

With the processing as mentioned above, the processing of the subroutine shown in FIG. 10 with regard to the discrimination as to whether a margin region for a density adjustment patch image exists or not (Step S103 in FIG. 3) is ended.

Herein, the processing is returned to the main flow chart shown in FIG. 3. In the case where a margin region for a density adjustment patch image does not exist (NO at Step S104 in FIG. 3), the control section 101 adjusts the arrangement of image portions (label regions) in the image data and produces a margin region for a density adjustment patch image (Step S105 in FIG. 3).

In the case where a margin region for a density adjustment patch images exists (YES at Step S104 in FIG. 3), the production of a margin region is not needed (Step S105 in FIG. 3).

Hereinafter, description is given to an arrangement adjustment (Step S105 in FIG. 3) with reference to a flow chart of a subroutine shown in FIG. 11.

First, the control section 101 provides a margin region capable of being used to image formation for a density adjustment patch image at a position of the density detecting sensor 170. Further, the control section 101 calculates an arrangement state of respective label regions in remaining regions in the main scanning direction (Step S1051 in FIG. 11). Herein, as the adjustment of the arrangement of label regions, any one of replacement of the order in the main scanning direction, shift in the main scanning direction, and replacement of the order in the main scanning direction and shift in the main scanning direction.

Herein, "replacement of the order in the main scanning direction" means that in the case where multiple label regions exist in the main scanning direction, all or a part of the label regions are replaced in terms of position in the main scanning direction.

Further, "shift in the main scanning direction" means that in the case where one or two or more label regions exist in the main scanning direction, their positions are shifted in the main scanning direction.

Furthermore, "replacement of the order in the main scanning direction and shift in the main scanning direction" means that in the case where multiple label regions exist in the main scanning direction, all or a part of the label regions are replaced in terms of position in the main scanning direction and the position of any of the label regions is shifted in the main scanning direction. In this case, the replacement of the order and the shift may be executed for the same label region or the replacement of the order and the shift may be executed for different label regions.

Figure 11:
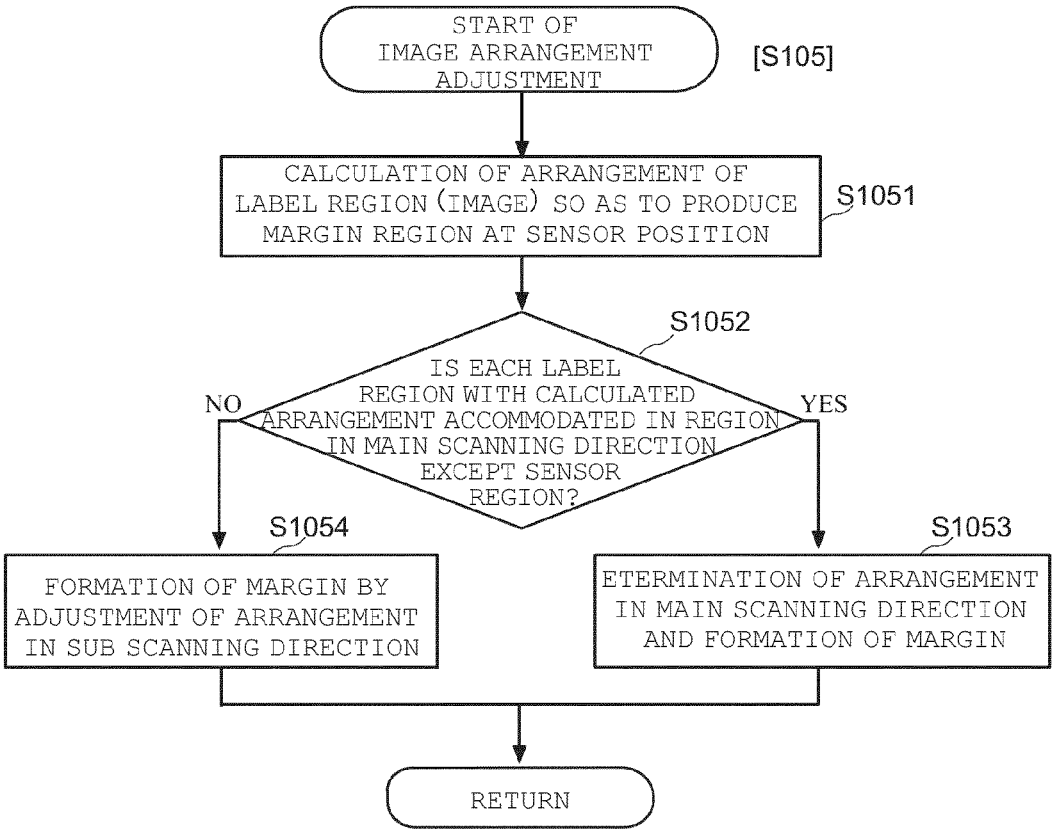
FIG. 11 is a flow chart showing operation of a sheet feeding apparatus of an embodiment of the present invention.

Then, the control section 101 judges whether the label regions with the arrangement calculated as mentioned above are accommodated or not within a range where a margin region for a density adjustment patch image is excluded from the maximum width in the main scanning direction (Step S1052 in FIG. 11).

In the case where the label regions with the arrangement calculated as mentioned above are accommodated within a range where a margin region for a density adjustment patch image is excluded from the maximum width in the main scanning direction (YES at Step S1052 in FIG. 11), the control section 101 determines the arrangement of the label regions and produces a margin region (Step S1053 in FIG. 11).

Figure 12:
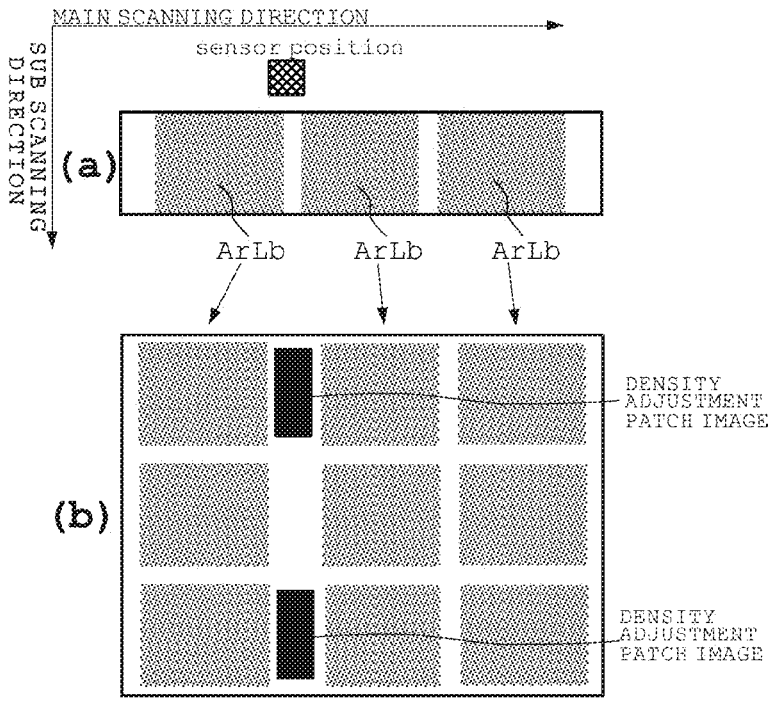
FIG. 12 is an explanatory drawing showing a state of images of an embodiment of the present invention.

FIG. 12(*a*) shows the original arrangement of the label regions, and there does not exist a margin region for a density adjustment patch image. Then, as a specific example, as shown in FIG. 12(*b*), the label regions are shifted in the main scanning direction and a margin region for a density adjustment patch image is produced.

Figure 13:
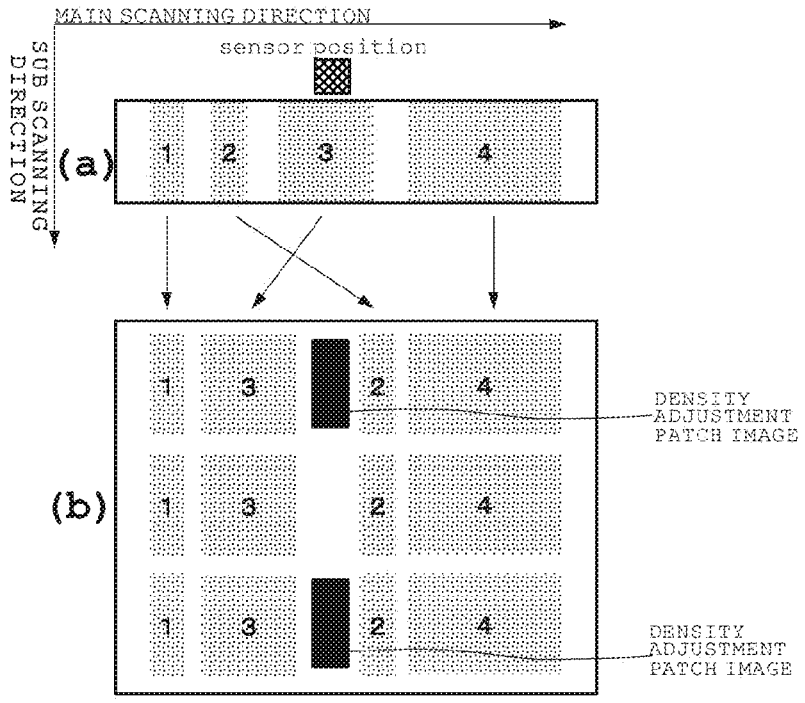
FIG. 13 is an explanatory drawing showing a state of images of an embodiment of the present invention.

FIG. 13(*a*) shows the original arrangement of the label regions, and there does not exist a margin region for a density adjustment patch image. Then, as a specific example, as shown in FIG. 13(*b*), the respective orders of the label regions are replaced in terms of position in the main scanning direction and a margin region for a density adjustment patch image is produced.

The arrangement may be adjusted by allowing the replacement of the respective orders of the label regions. Alternatively, the arrangement may be adjusted by not allowing the replacement of the respective orders of the label regions. Any one of the above settings may be used.

In the case where the label regions with the arrangement calculated as mentioned above are not accommodated within a range where a margin region for a density adjustment patch image is excluded from the maximum width in the main scanning direction (NO at Step S1052 in FIG. 11), the control section 101 adjusts newly the arrangement of the label regions in the sub scanning direction and produces a margin region (Step S1053 in FIG. 11).

Figure 14:
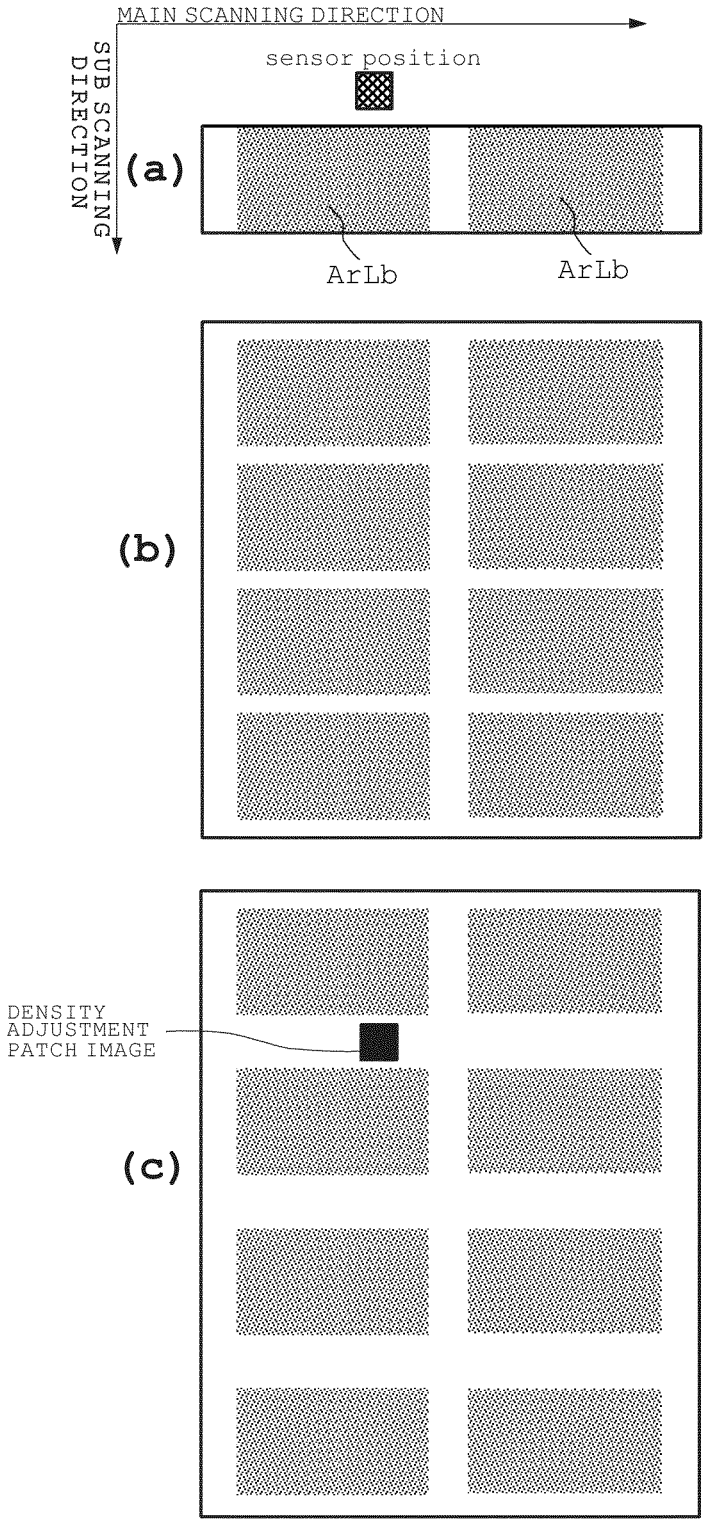
FIG. 14 is an explanatory drawing showing a state of images of an embodiment of the present invention.

Herein, FIG. 14(*a*) shows a case where a margin region for a density adjustment patch image cannot be produced with the adjustment of the arrangement in the main scanning direction. Then, as the adjustment in the sub scanning direction, a predetermined cycle to repeat image formation on a long sheet is set longer (FIG. 14(*c*)) than the case of forming only images (FIG. 14(*b*)), whereby, as a specific example, a margin region for a density adjustment patch image is produced in the sub scanning direction within the predetermined cycle.

Figure 15:
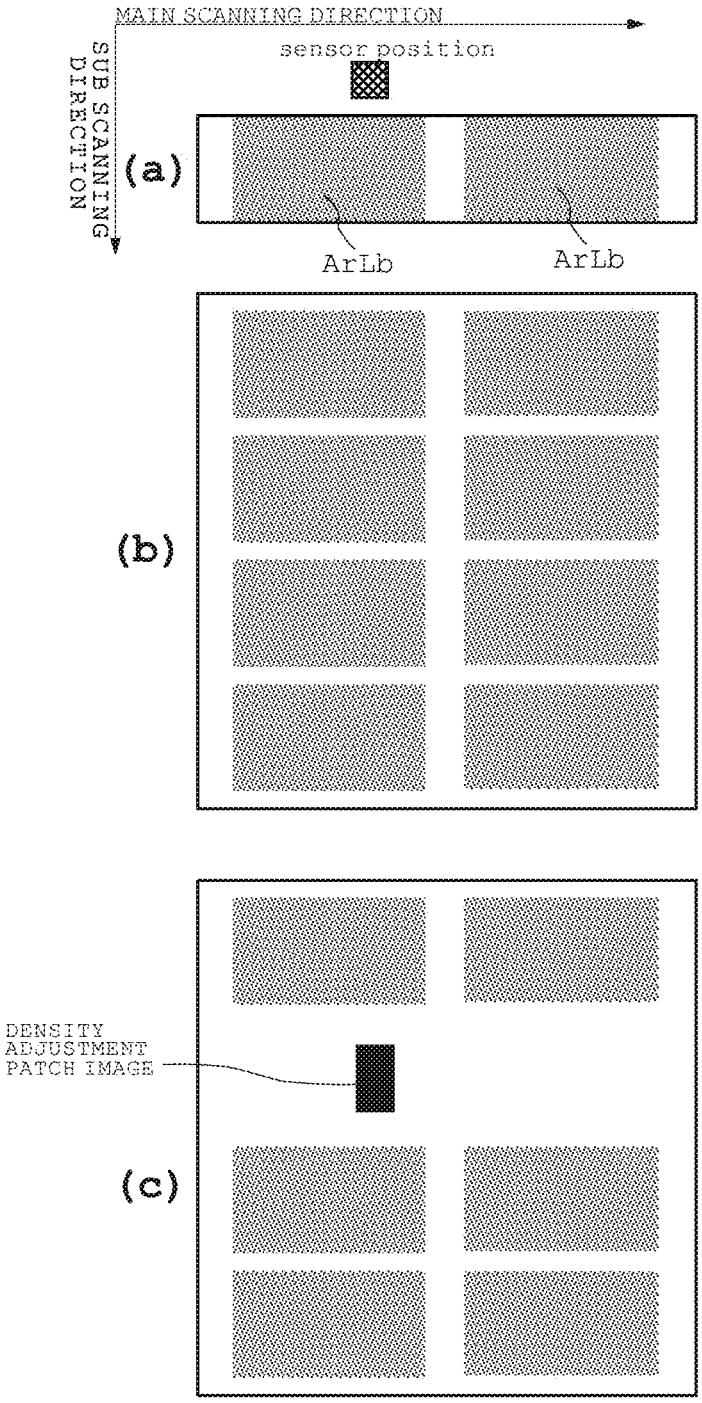
FIG. 15 is an explanatory drawing showing a state of images of an embodiment of the present invention.

Further, FIG. 15(*a*) shows a case where a margin region for a density adjustment patch image cannot be produced with the adjustment of the arrangement in the main scanning direction. Then, as the adjustment in a sub scanning direction, in any one cycle among the predetermined cycles to repeat image formation on a long sheet (FIG. 15(*b*)), as a specific example, images for image formation are not disposed, and a margin region is assigned (FIG. 15(C)) so as to dispose a density adjustment patch image thereon.

With the processing as mentioned above, the processing of the subroutine shown in FIG. 11 with regard to the production of a margin region for a density adjustment patch image by the adjustment of the arrangement of label regions (Step S105 in FIG. 3) is ended.

A density adjustment patch image is not necessarily formed for each time with the completely same cycle with a repeating cycle of labels. However, the adjustment of the arrangement of label regions and production of a margin region are controlled to maintain a predetermined state from start to end of a job as a unit of a series of image formation. With this, various kinds of post processing, such as cutting in the post processing apparatus becomes in a fixed state, whereby various kinds of faults can be prevented.

Herein, the processing is returned to the main flow chart shown in FIG. 3, and the control section 101 sets a density adjustment patch image region and a toner consumption patch image region corresponding to the margin regions produced as mentioned above (Step S106 in FIG. 3).

Figure 16:
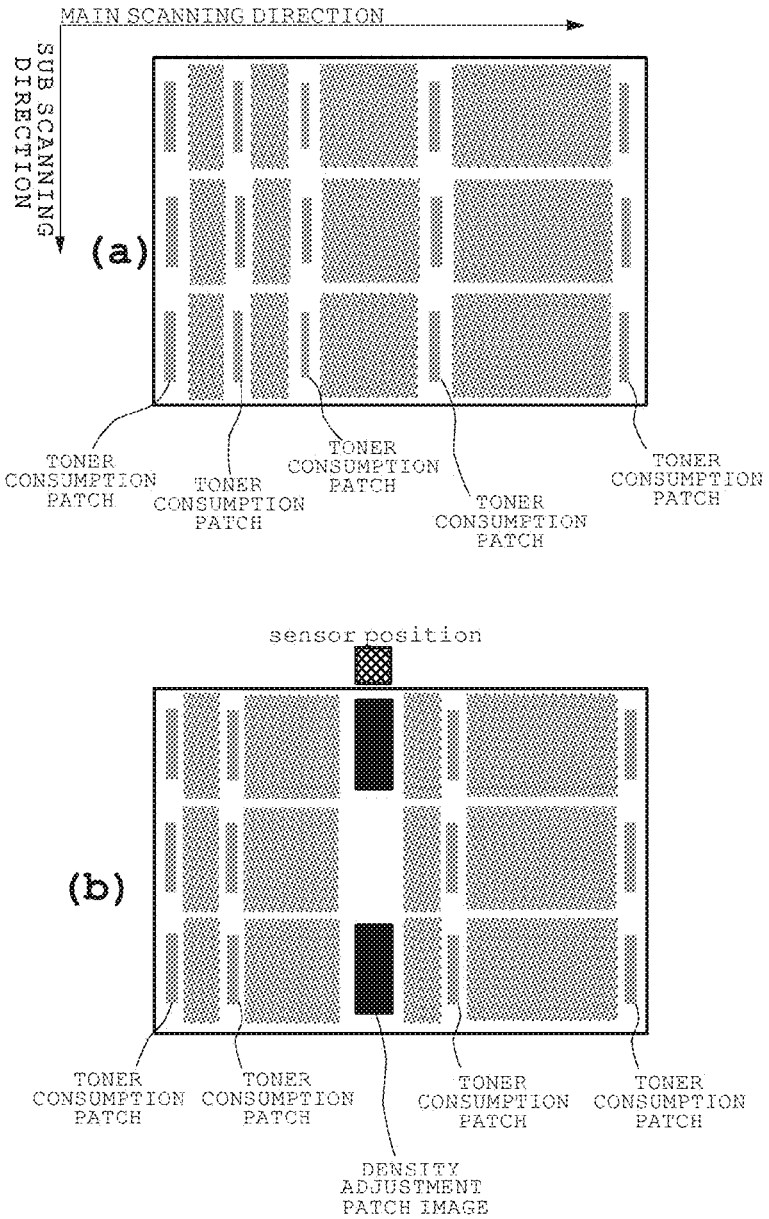
FIG. 16 is an explanatory drawing showing a state of images of an embodiment of the present invention.

Since it is not necessary for the toner consumption patch image to be read by a sensor, as shown in FIG. 16 (*a*), the toner consumption patch image can be arranged at each margin region. Further, it is desirable to dispose toner consumption patch images as equally as possible in the main scanning direction. However, the toner consumption patch image is not necessarily disposed at all margin regions and can be set arbitrarily.

Further, in the case where toner consumption patch images and density adjustment patch images are intermixed, as shown in FIG. 16 (*b*), a density adjustment patch image is formed at the position of the density detecting sensor 170, and a toner consumption patch image is arranged at each margin region other than the position of the density detecting sensor 170. In this case, it is also desirable to dispose toner consumption patch images as equally as possible in the main scanning direction. However, a toner consumption patch image is not necessarily disposed at all vacant margin regions and can be set arbitrarily. That is, in the case where image formation is performed by making toner adhere to a long sheet, in the case where the control section 101 detects multiple margin regions in the main scanning direction, the control section 101 controls image formation so as to dispose a toner consumption patch image to consume toner on at least two or more margin regions among the multiple margin regions.

At a time when density adjustment patch image regions and toner consumption patch image regions are set with the processing as mentioned above, the control section 101 controls the image forming section 150 to start image formation (Step S107 in FIG. 3).

Then, the control section 101 controls so as to form a density adjustment patch image on a margin region in a necessary timing during image formation (YES at Step S108 in FIG. 3, S109). Further, the control section 101 controls the density detecting sensor 170 to read the density adjustment patch image and executes density correction such that the image formation density of the image forming section 150 becomes a predetermined value (Step S110 in FIG. 3).

Further, with regard to color toner only a small amount of which has been consumed for a predetermined elapsed time, the control section 101 controls the image forming section 150 to form a toner consumption patch image on a toner consumption patch image region in a margin region (Step S112 in FIG. 3). That is, in the case where image formation is performed by making multiple different color toners adhere to a long sheet, the control section 101 controls image formation to dispose preferentially toner consumption patch images of a color toner consumed little as compared with other color toners.

Herein, in the case of forming a density adjustment patch image without being intermixed with a toner consumption patch image, as having already described, and as shown in FIG. 12(*b*), FIG. 13(*b*), FIG. 14(*c*), and FIG. 15(*c*), it is possible to form a density adjustment patch image in an density adjustment patch image region corresponding to the density detecting sensor 170.

Further, when a toner consumption patch image is formed without being intermingled with a density adjustment patch image, as having been already described, and as shown in FIG. 16 (*a*), it is possible to form a toner consumption patch image in an arbitrary margin region.

On the other hand, in the case where a density adjustment patch image and a toner consumption patch image are formed in the same timing in the above control, as having already described, it is possible to form them by make them intermixed with each other as shown in FIG. 16(*b*).

Figure 17:
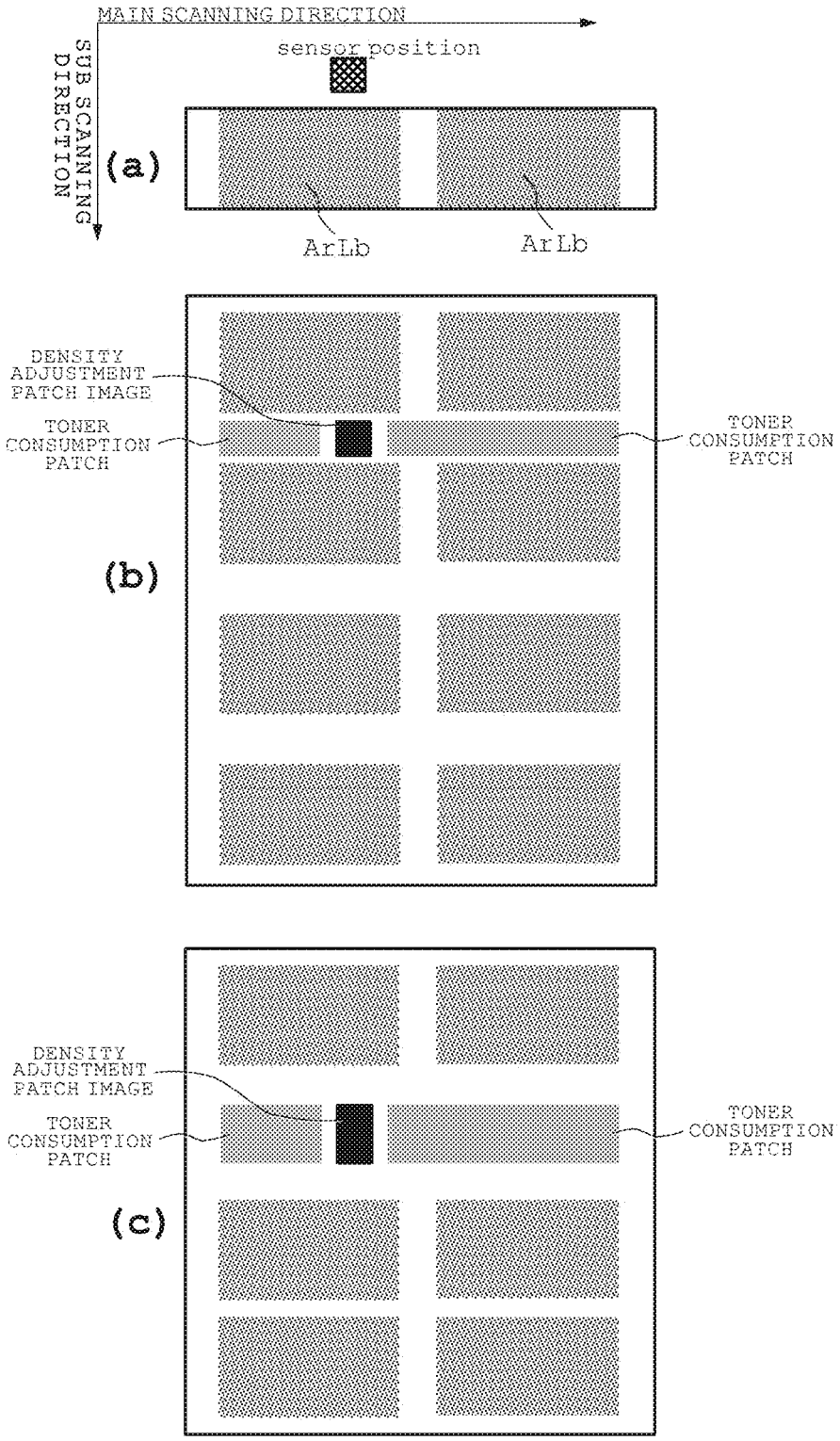
FIG. 17 is an explanatory drawing showing a state of images of an embodiment of the present invention.

Further, in the above control, in the case where a density adjustment patch image and a toner consumption patch image are formed in the same timing, and in the case where the density adjustment patch images are arranged in the sub scanning direction as shown in FIG. 14(*c*) and FIG. 15(*c*), as shown in FIG. 17(*b*) and FIG. 17(*c*), it is possible to form them by arranging the toner consumption patch image and the density adjustment patch image side by side so as to intermix them. Further, in this case, only the toner consumption patch image may be formed separately on a usual margin portion.

As mentioned above, in this embodiment, in the case of forming images by using a long sheet with a sheet length in the conveying direction longer than that of a sheet length with a fixed sheet size, images are controlled to be formed repeatedly with a predetermined cycle on a long sheet, a margin region being a region where images are not formed on a long sheet is detected, and image formation is performed so as to dispose patch images on the margin region, whereby in the case of forming images on a long sheet, patch images can be formed without changing a cycle of image formation. Therefore, a problem of control in a post processing apparatus at the time of changing a cycle of image formation does not occur.

Other Embodiments

In the above description, the control section 101 in the image forming apparatus 100 or a control device is made to perform various kinds of control. However, the present invention should not be limited to this example.

For example, it may be also possible that an external PC capable of communicating with the image forming apparatus 100 executes various kinds of the above-mentioned control. Further, it may be also possible that a printer driver in an external PC capable of communicating with the image forming apparatus 100 executes various kinds of the above-mentioned control. That is, the above-mentioned control may be performed as an image formation control method.

Further, as long as an image forming apparatus and an image forming system each handles a long sheet and can execute operations in the above-mentioned embodiments, their constitutions should not be limited to the specific constitution shown in FIG. 1 and FIG. 2.

Further, in the control in the above embodiment, the detection and production of margin regions are performed with reference to the attribute data. However, the present invention should not be limited to this example.

For example, in the case of receiving coordinate information with regard to the arrangement of images together with the reception of a job or after the reception of a job, the detection and production of margin regions and the adjustment of the arrangement of images can be performed with reference to the coordinate information.

Effects Acquired by the Embodiments

According to the image forming apparatus, the image forming system, and the image formation control method in the above embodiments, the following effects can be attained.

(1) In this embodiment, in the case of forming an image by using a long sheet with a sheet length longer in a conveying direction than that of a sheet with a fixed paper size, images are controlled to be formed repeatedly with a predetermined cycle on a long sheet, a margin region being a region where images are not formed on a long sheet is detected, and image formation is performed so as to dispose a patch image on the margin region. As a result, in the case of forming images on a long sheet, a patch image can be formed without changing a cycle of images. Therefore, a problem of control in a post processing apparatus at the time of changing a cycle of image formation does not occur.

(2) In the above (1), a margin region is detected in a main scanning direction, and image formation is controlled so as to arrange a patch image on the margin region. As a result, productivity is not worsened in any way, and in the case of forming images on a long sheet, patch images can be formed without changing a cycle of images.

(3) In the above (2), in the case where image formation is performed by making toner adhere to a long sheet, and in the case of detecting multiple margin regions in the main scanning direction, image formation is controlled so as to dispose a toner consumption patch image to consume toner on at least two or more margin regions among the multiple margin regions. As a result, productivity is not worsened in any way, unnecessary toner is consumed surely, and in the case of forming images on a long sheet, a patch image can be formed without changing a cycle of images.

(4) In the above (2) to (3), in the case where image formation is performed by making multiple different color toners adhere to a long sheet, image formation is controlled to dispose preferentially a toner consumption patch image of a color toner consumed little as compared with other color toners. As a result, productivity is not worsened in any way, unnecessary toner is consumed surely in accordance with priority, and in the case of forming images on a long sheet, a patch image can be formed without changing a cycle of images.

(5) In the above (1) to (4), in the case where a sensor to detect a density of an image is disposed at a predetermined position in the main scanning direction, a margin region disposed in the main scanning direction is detected, and image formation is controlled so as to dispose a density adjustment patch image on a margin region at a position which coincides with the position of the sensor in the main scanning direction. As a result, in the case of forming images on a long sheet, a density adjustment patch image can be formed without changing a cycle of images. Therefore, a problem of control in a post processing apparatus at the time of changing a cycle of image formation does not occur, and it becomes possible to execute periodically processing (image stabilization processing) to stabilize an image density.

(6) In the above (1) to (5), in the case of forming images on a long sheet, the arrangement of images in the main scanning direction is adjusted, a margin region is produced at a position which coincides with the position of the sensor in the main scanning direction, and image formation is controlled so as to dispose a density adjustment patch image on the produced margin region. As a result, in the case of forming images on a long sheet, a density adjustment patch image can be formed without changing a cycle of images. Therefore, a problem of control in a post processing apparatus at the time of changing a cycle of image formation does not occur, and it becomes possible to execute periodically processing (image stabilization processing) to stabilize an image density. Further, the arrangement of images in the main scanning direction is adjusted, and a margin region is produced at a position which coincides with a position of a sensor in the main scanning direction. Accordingly, even in the case where a margin region does not exist at the position of the sensor, it becomes possible to cope with.

(7) In the above (6), in the case of forming images on a long sheet, the arrangement of images in the main scanning direction is adjusted, and at the time of producing a margin region at a position which coincides with the position of a sensor in the main scanning direction, the adjustment of the arrangement is executed by any one of replacement of the order of the images in the main scanning direction, shift of the images in the main scanning direction, and replacement of the order of the images in the main scanning direction and shift of the images in the main scanning direction. As a result, at the time of forming images on a long sheet, a density adjustment patch image can be formed without changing a cycle of images. Further, the adjustment of the arrangement of the images in the main scanning direction is adjusted by any one of replacement of the order of the images in the main scanning direction, shift of the images in the main scanning direction, and replacement of the order of the images in the main scanning direction and shift of the images in the main scanning direction, and a margin region is produced at a position which coincides with the position of the sensor in the main scanning direction. Accordingly, in the case where a margin region does not exist at the position of the sensor, it is possible to cope with securely.

(8) In the above (1) to (7), in the case where a sensor to detect a density of an image is disposed at a predetermined position in the main scanning direction, an a margin region does not exist at a position which coincides with the position of the sensor in the main scanning direction, or a margin region cannot be produced at a position which coincides with the position of the sensor in the main scanning direction regardless of the adjustment of the arrangement of images, a predetermined cycle to repeat image formation is set longer than the case of forming only images, whereby the margin region is produced in the sub scanning direction within the predetermined cycle, and image formation is controlled so as to dispose a density adjustment patch image at a position which is located in the produced margin region and coincides with the position of the sensor in the main scanning direction. As a result, in the case of forming images on a long sheet, a density adjustment patch image can be formed with the control of the predetermined cycle without changing a cycle of images in the course of image formation.

(9) In the above (1) to (7), in the case where a sensor to detect a density of an image is disposed at a predetermined position in the main scanning direction, and a margin region does not exist at a position which coincides with the position of the sensor in the main scanning direction, or a margin region cannot be produced at a position which coincides with the position of the sensor in the main scanning direction regardless of the adjustment of the arrangement of images, image formation is controlled in any one cycle among the predetermined cycles so as to dispose a density adjustment patch image on at least a position which coincides with the position of the sensor in the main scanning direction without disposing images for image formation. As a result, in the case of forming images on a long sheet, a density adjustment patch image can be formed with the control of a predetermined cycle without changing a cycle of images in the course of image formation.

(10) In the above (1) to (9), in the case where a sensor to detect a density of an image is disposed at a predetermined position in the main scanning direction, a margin region in the main scanning direction is detected, image formation is controlled so as to dispose a density adjustment patch image on the margin region at a position which coincides with the position of the sensor in the main scanning direction, and the image formation is further controlled so as to dispose a toner consumption patch image to consume toner on the margin region other than the position where the density adjustment patch image is formed. As a result, in the case of forming images on a long sheet, both the density adjustment patch image and the toner consumption patch image can be formed without changing a cycle of images.

(11) In the above (5) to (10), in the case where a margin region in the main scanning direction is detected and image formation is controlled so as to dispose a density adjustment patch image on a margin region at a position which coincides with the position of the sensor in the main scanning direction, the arrangement is controlled to maintain a predetermined state from start to end of a job as a unit of a series of image formation. As a result, in the case of forming images on a long sheet, a patch image can be formed without changing a cycle of images. Therefore, a problem of control in a post processing apparatus at the time of changing a cycle of image formation does not occur.

(12) In the above (1) to (11), in the case where first information regarding the color or density of an image in a figure region and second information regarding attribute showing whether an image is formed in a figure region or in a background region are exist, the margin region is detected with reference to the second information. As a result, the margin regions can be detected surely from the second information, and in the case of forming images on a long sheet, a patch image can be formed without changing a cycle of images.

(13) In the above (1) to (11), in the case where coordinate information regarding the arrangement of images exists, the margin region is detected with reference to the coordinate information. As a result, the margin regions can be detected surely from the coordinate information, and at the time of forming images on a long sheet, patch images can be formed without changing a cycle of images.

What is claimed is:

1. An image forming apparatus, comprising:

a control section which controls, in the case of forming an image by using a long sheet with a sheet length in a conveying direction longer than that of a sheet length with a fixed paper size, so as to perform image formation by arranging multiple images on the long sheet;

wherein the control section controls so as to form images repeatedly with a predetermined cycle on the long sheet, detects a margin region being a region where images are not formed on the long sheet, and controls image formation so as to dispose a patch image on the margin region.

2. The image forming apparatus described in claim 1, wherein in the case where a direction to convey the long sheet during image formation is made to a sub scanning direction and a direction orthogonal to the sub scanning direction on the long sheet is made to a main scanning direction, the control section detects the margin region in the main scanning direction and controls image formation so as to dispose the patch image on the margin region.

3. The image forming apparatus described in claim 2, wherein in the case where image formation is performed by making toner adhere to the long sheet, and in the case of detecting multiple margin regions in the main scanning direction, the control section controls image formation so as to dispose a toner consumption patch image to consume toner on at least two or more margin regions among the multiple margin regions.

4. The image forming apparatus described in claim 2, wherein in the case where image formation is performed by making multiple different color toners adhere to the long sheet, the control section controls image formation so as to dispose preferentially a toner consumption patch image of a color toner consumed little as compared with other color toners.

5. The image forming apparatus described in claim 1, wherein in the case where a direction to convey the long sheet during image formation is made to a sub scanning direction and a direction orthogonal to the sub scanning direction on the long sheet is made to a main scanning direction, a sensor to detect a density of an image is disposed at a predetermined position in the main scanning direction, and the control section detects a margin region in the main scanning direction and controls image formation so as to dispose a density adjustment patch image on the margin region at a position which coincides with the position of the sensor in the main scanning direction.

6. The image forming apparatus described in claim 1, wherein the control section adjusts arrangement in the main scanning direction in the case of forming images on the long sheet, produces a margin region at a position which coincides with the position of the sensor in the main scanning direction, and controls image formation so as to dispose a density adjustment patch image on the produced margin region.

7. The image forming apparatus described in claim 6, wherein when the control section adjusts the arrangement in the main scanning direction in the case of forming images on the long sheet and produces the margin region at the position which coincides with the position of the sensor in the main scanning direction, the control section executes the adjustment of the arrangement by any one of replacement of the order of the images in the main scanning direction, shift of the images in the main scanning direction, and replacement of the order of the images in the main scanning direction and shift of the images in the main scanning direction.

8. The image forming apparatus described in claim 1, wherein in the case where a direction to convey the long sheet during image formation is made to a sub scanning direction and a direction orthogonal to the sub scanning direction on the long sheet is made to a main scanning direction, a sensor to detect a density of an image is disposed at a predetermined position in the main scanning direction; and in the case where a margin region is detected in the main scanning direction and the detected margin region does not exist at a position which coincides with the position of the sensor in the main scanning direction, or in the case where, even though a margin region is detected in the main scanning direction and the arrangement of images is adjusted, a margin region cannot be produced at a position which coincides with the position of the sensor in the main scanning direction, the control section sets the predetermined cycle to repeat image formation to be longer than the case of forming only images, whereby the control section produces a margin region in the sub scanning direction within the predetermined cycle, and controls image formation so as to dispose a density adjustment patch image at a position which locates in the produced margin region and coincides with the position of the sensor in the main scanning direction.

9. The image forming apparatus described in claim 1, wherein in the case where a direction to convey the long sheet during image formation is made to a sub scanning direction and a direction orthogonal to the sub scanning direction on the long sheet is made to a main scanning direction, a sensor to detect a density of an image is disposed at a predetermined position in the main scanning direction; and in the case where a margin region is detected in the main scanning direction and the detected margin region does not exist at a position which coincides with the position of the sensor in the main scanning direction, or in the case where, even though a margin region is detected in the main scanning direction and the arrangement of images is adjusted, a margin region cannot be produced at a position which coincides with the position of the sensor in the main scanning direction, the control section controls image formation in any one cycle among the predetermined cycles so as to dispose a density adjustment patch image on at least a position which coincides with the position of the sensor in the main scanning direction without disposing images for image formation.

10. The image forming apparatus described in claim 1, wherein in the case where a direction to convey the long sheet during image formation is made to a sub scanning direction and a direction orthogonal to the sub scanning direction on the long sheet is made to a main scanning direction, a sensor to detect a density of an image is disposed at a predetermined position in the main scanning direction, and the control section detects the margin region in the main scanning direction, controls image formation so as to dispose a density adjustment patch image on the margin region at a position which coincides with the position of the sensor in the main scanning direction, and controls image formation so as to dispose a toner consumption patch image to consume toner on the margin region other than the position where the density adjustment patch image is formed.

11. The image forming apparatus described in claim 1, wherein in the case where the control section detects the margin region in the main scanning direction and controls image formation so as to dispose a density adjustment patch image on the margin region at a position which coincides with the position of the sensor in the main scanning direction, the control section controls so as to maintain the arrangement in a predetermined state from start to end of a job as a unit of a series of image formation.

12. The image forming apparatus described in claim 1, wherein in the case where first information regarding the color or density of an image in a figure region and second information regarding attribute showing whether an image is a figure region or a background region are exist, the control section detects the margin region with reference to the second information.

13. The image forming apparatus described in claim 1, wherein in the case where coordinate information regarding arrangement of images exists, the control section detects the margin region with reference to the coordinate information.

14. An image forming system, comprising:

a sheet feeding apparatus which feeds a long sheet with a sheet length in a conveying direction longer than that of a sheet length with a fixed paper size;

an image forming apparatus which forms images on the long sheet; and a control apparatus which controls image formation so as to dispose multiple images on the long sheet;

wherein the control apparatus controls so as to form images repeatedly with a predetermined cycle on the long sheet, detects a margin region being a region where images are not formed on the long sheet, and controls image formation so as to dispose a patch image on the margin region.

15. An image formation control method which controls an image forming apparatus, in the case of forming an image by using a long sheet with a sheet length in a conveying direction longer than that of a sheet length with a fixed paper size, so as to perform image formation by arranging multiple images on the long sheet, comprising the steps of:

controlling the image forming apparatus so as to form images repeatedly with a predetermined cycle on the long sheet, and controlling the image forming apparatus so as to detect a margin region being a region where images are not formed on the long sheet, and to perform image formation so as to dispose a patch image on the margin region.

16. The image formation control method described in claim 15, wherein in the case where a direction to convey the long sheet during image formation is made to a sub scanning direction and a direction orthogonal to the sub scanning direction on the long sheet is made to a main scanning direction, the image forming apparatus is controlled to detect the margin region in the main scanning direction and to perform image formation so as to dispose the patch image on the margin region.

17. The image formation control method described in claim 16, wherein in the case where image formation is performed by making toner adhere to the long sheet, and in the case of detecting multiple margin regions in the main scanning direction, the image forming apparatus is controlled to perform image formation so as to dispose a toner consumption patch image to consume toner on at least two or more margin regions among the multiple margin regions.

18. The image formation control method described in claim 16, wherein in the case where image formation is performed by making multiple different color toners adhere to the long sheet, the image forming apparatus is controlled to perform image formation so as to dispose preferentially a toner consumption patch image of a color toner consumed little as compared with other color toners.

19. The image formation control method described in claim 15, wherein in the case where a direction to convey the long sheet during image formation is made to a sub scanning direction, a direction orthogonal to the sub scanning direction on the long sheet is made to a main scanning direction, and the image forming apparatus includes a sensor to detect a density of an image at a predetermined position in the main scanning direction, the image forming apparatus is controlled to detect a margin region in the main scanning direction and to perform image formation so as to dispose a density adjustment patch image on the margin region at a position which coincides with the position of the sensor in the main scanning direction.

20. The image formation control method described in claim 15, wherein the image forming apparatus is controlled to adjust arrangement in the main scanning direction in the case of forming images on the long sheet, to produce a margin region at a position which coincides with the position of the sensor in the main scanning direction, and to perform image formation so as to dispose a density adjustment patch image on the produced margin region.

21. The image formation control method described in claim 20, wherein when the image forming apparatus adjusts the arrangement in the main scanning direction at the time of forming images on the long sheet and produces the margin region at the position which coincides with the position of the sensor in the main scanning direction, the image forming apparatus executes the adjustment of the arrangement by any one of replacement of the order of the images in the main scanning direction, shift of the images in the main scanning direction, and replacement of the order of the images in the main scanning direction and shift of the images in the main scanning direction.

22. The image formation control method described in claim 15, wherein in the case where a direction to convey the long sheet during image formation is made to a sub scanning direction, a direction orthogonal to the sub scanning direction on the long sheet is made to a main scanning direction, and the image forming apparatus includes a sensor to detect a density of an image at a predetermined position in the main scanning direction; and in the case where a margin region is detected in the main scanning direction and the detected margin region does not exist at a position which coincides with the position of the sensor in the main scanning direction, or in the case where, even though the arrangement of images is adjusted, a margin region cannot be produced at a position which coincides with the position of the sensor in the main scanning direction, the image forming apparatus is controlled to set the predetermined cycle to repeat image formation to be longer than the case of forming only images, whereby the image forming apparatus produces a margin region in the sub scanning direction within the predetermined cycle, and performs image formation so as to dispose a density adjustment patch image at a position which locates in the produced margin region and coincides with the position of the sensor in the main scanning direction.

23. The image formation control method described in claim 15, wherein in the case where a direction to convey the long sheet during image formation is made to a sub scanning direction, a direction orthogonal to the sub scanning direction on the long sheet is made to a main scanning direction, and the image forming apparatus includes a sensor to detect a density of an image at a predetermined position in the main scanning direction; and in the case where a margin region is detected in the main scanning direction and the detected margin region does not exist at a position which coincides with the position of the sensor in the main scanning direction, or in the case where, even though the arrangement of images is adjusted, a margin region cannot be produced at a position which coincides with the position of the sensor in the main scanning direction, the image forming apparatus is controlled to perform image formation in any one cycle among the predetermined cycles so as to dispose a density adjustment patch image on at least a position which coincides with the position of the sensor in the main scanning direction without disposing images for image formation.

24. The image formation control method described in claim 15, wherein in the case where a direction to convey the long sheet during image formation is made to a sub scanning direction, a direction orthogonal to the sub scanning direction on the long sheet is made to a main scanning direction, and the image forming apparatus includes a sensor to detect a density of an image at a predetermined position in the main scanning direction; the image forming apparatus is controlled to detect the margin region in the main scanning direction, perform image formation so as to dispose a density adjustment patch image on the margin region at a position which coincides with the position of the sensor in the main scanning direction, and perform image formation so as to dispose a toner consumption patch image to consume toner on the margin region other than the position where the density adjustment patch image is formed.

25. The image formation control method described in claim 15, wherein in the case where the image forming apparatus detects the margin region in the main scanning direction and performs image formation so as to dispose a density adjustment patch image on the margin region at a position which coincides with the position of the sensor in the main scanning direction, t the image forming apparatus is controlled so as to maintain the arrangement in a predetermined state from start to end of a job as a unit of a series of image formation.

26. The image formation control method described in claim 15, wherein in the case where first information regarding the color or density of an image in a figure region and second information regarding attribute showing whether an image is a figure region or a background region are exist, the margin region is detected with reference to the second information.

27. The image formation control method described in claim 15, wherein in the case where coordinate information regarding arrangement of images exists, the margin region is detected with reference to the coordinate information.

* * * * *